US008715118B2

(12) United States Patent
Epling et al.

(10) Patent No.: US 8,715,118 B2
(45) **Date of Patent: *May 6, 2014**

(54) BALL BAT INCLUDING A BARREL PORTION HAVING SEPARATE PROXIMAL AND DISTAL MEMBERS

(75) Inventors: Sean S. Epling, Portland, OR (US); Mark A. Fritzke, Portland, OR (US); Ty B. Goodwin, Vancouver, WA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/980,613

(22) Filed: Dec. 29, 2010

(65) Prior Publication Data

US 2012/0108368 A1 May 3, 2012

Related U.S. Application Data

(60) Provisional application No. 61/409,287, filed on Nov. 2, 2010.

(51) Int. Cl.
*A63B 59/06* (2006.01)

(52) U.S. Cl.
USPC ..... 473/567; 473/566; 473/564

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 1,509,733 | A * | 9/1924 | Langford | 473/520 |
| D197,180 | S | 12/1963 | Salisbury | 273/72 |
| 3,116,926 | A | 1/1964 | Owen et al. | 273/72 |
| 3,830,496 | A | 8/1974 | Reizer | 173/72 |
| 3,861,682 | A | 1/1975 | Fujii | 273/72 |
| 3,876,204 | A | 4/1975 | Moore et al. | 273/72 |
| 3,877,698 | A | 4/1975 | Volpe | 473/520 |
| 3,955,816 | A | 5/1976 | Bratt | 273/26 |
| 3,963,239 | A | 6/1976 | Fujii | 273/72 |
| 4,025,377 | A | 5/1977 | Tanikawa | 156/242 |
| 4,032,143 | A | 6/1977 | Mueller et al. | 273/72 |
| 4,056,267 | A | 11/1977 | Kriegar | 273/72 |
| 4,113,248 | A | 9/1978 | Yanagioka | 273/72 |
| 4,323,239 | A | 4/1982 | Ishii | 273/72 |
| 4,351,786 | A | 9/1982 | Mueller | 264/46 |
| 4,505,479 | A | 3/1985 | Souders | 273/72 |
| 4,569,521 | A | 2/1986 | Mueller | 273/72 |
| 4,572,508 | A | 2/1986 | You | 73/72 |
| 4,600,193 | A | 7/1986 | Merritt | 273/72 |
| 4,746,117 | A | 5/1988 | Noble | 273/72 |
| 4,834,370 | A | 5/1989 | Noble et al. | 273/72 |
| 4,848,745 | A | 7/1989 | Bohannan et al. | 273/72 |
| 4,951,948 | A | 8/1990 | Peng | 273/72 |

(Continued)

*Primary Examiner* — Mark Graham

(74) *Attorney, Agent, or Firm* — Terence P. O'Brien

(57) ABSTRACT

A ball bat extending about a longitudinal axis. The bat includes a handle and a barrel portion. The barrel portion has an outer surface and includes a proximal member and a distal member. The proximal member has first and second end regions and the distal member has third and fourth end regions. The first end region is coupled to the handle portion, the second end region of the proximal member is coupled to the third end region of the distal member, and the fourth end region of the distal member is coupled to an end cap. At least a portion of each of the proximal and distal members defines the outer surface of the barrel portion. One of the second and third end regions overlaps the other of the second and third end regions.

18 Claims, 16 Drawing Sheets

(56) References Cited

U.S. PATENT DOCUMENTS

| | | | | | |
|---|---|---|---|---|---|
| 4,961,576 | A | | 10/1990 | Meredith | 273/72 |
| 5,094,453 | A | | 3/1992 | Douglas et al. | 273/72 |
| 5,104,123 | A | | 4/1992 | Okitsu et al. | 273/72 |
| 5,131,651 | A | | 7/1992 | You | 73/72 |
| 5,180,163 | A | | 1/1993 | Lanctot | 273/72 |
| 5,219,164 | A | | 6/1993 | Peng | 273/72 |
| 5,303,917 | A | | 4/1994 | Uke | 73/72 |
| 5,380,003 | A | | 1/1995 | Lanctot | 273/72 |
| 5,409,214 | A | | 4/1995 | Cook | 473/564 |
| 5,415,398 | A | | 5/1995 | Eggiman et al. | 273/72 |
| 5,511,777 | A | | 4/1996 | McNeely | 273/72 |
| 5,516,097 | A | | 5/1996 | Huddleston | 273/26 |
| 5,593,158 | A | | 1/1997 | Filice et al. | 473/520 |
| 5,676,609 | A | * | 10/1997 | Mollebaek | 473/564 |
| 5,722,908 | A | * | 3/1998 | Feeney et al. | 473/567 |
| 6,050,908 | A | | 4/2000 | Muhlhausen | 473/457 |
| 6,056,655 | A | | 5/2000 | Feeney et al. | 473/567 |
| 6,334,824 | B1 | | 1/2002 | Filice et al. | 473/566 |
| 6,344,007 | B1 | | 2/2002 | Feeney et al. | 473/567 |
| 6,432,006 | B1 | | 8/2002 | Tribble | 473/564 |
| 6,440,017 | B1 | | 8/2002 | Anderson | 473/566 |
| 6,485,382 | B1 | | 11/2002 | Chen | 473/566 |
| 6,511,392 | B1 | | 1/2003 | Chohan | 473/564 |
| 6,702,698 | B2 | | 3/2004 | Eggiman et al. | 473/566 |
| 6,743,127 | B2 | | 6/2004 | Eggiman et al. | 473/567 |
| 6,761,653 | B1 | | 7/2004 | Higginbotham et al. | 473/566 |
| 6,945,886 | B2 | | 9/2005 | Eggiman et al. | 473/566 |
| 6,969,330 | B1 | * | 11/2005 | Meeker | 473/567 |
| 7,097,578 | B2 | | 8/2006 | Guenther et al. | 473/567 |
| 7,140,988 | B1 | | 11/2006 | Hinman | 473/566 |
| 7,410,433 | B2 | | 8/2008 | Guenther et al. | 473/567 |
| 7,749,115 | B1 | * | 7/2010 | Cruz et al. | 473/567 |
| 7,942,764 | B2 | * | 5/2011 | Chung | 473/564 |
| 7,955,200 | B1 | * | 6/2011 | Cruz et al. | 473/567 |
| 8,197,365 | B2 | | 6/2012 | Tokieda | 473/566 |
| 8,317,640 | B1 | | 11/2012 | Cruz et al. | 473/567 |
| 2002/0094892 | A1 | * | 7/2002 | Chauvin et al. | 473/566 |
| 2002/0183142 | A1 | | 12/2002 | Higginbotham | 473/564 |
| 2003/0004020 | A1 | | 1/2003 | Ogawa et al. | 473/564 |
| 2003/0158006 | A1 | * | 8/2003 | Tribble | 473/564 |
| 2004/0127310 | A1 | | 7/2004 | Hsu | 473/567 |
| 2005/0277497 | A1 | * | 12/2005 | Chang | 473/567 |
| 2007/0155546 | A1 | | 7/2007 | Chauvin et al. | 473/520 |
| 2008/0064538 | A1 | * | 3/2008 | McNamee et al. | 473/564 |
| 2009/0029810 | A1 | | 1/2009 | Fitzgerald et al. | 473/564 |
| 2009/0280935 | A1 | * | 11/2009 | Watari et al. | 473/566 |
| 2010/0113194 | A1 | * | 5/2010 | Tokieda | 473/566 |
| 2011/0124447 | A1 | * | 5/2011 | Chauvin et al. | 473/566 |
| 2011/0195808 | A1 | * | 8/2011 | Chauvin | 473/564 |

* cited by examiner

BALL BAT INCLUDING A BARREL PORTION HAVING SEPARATE PROXIMAL AND DISTAL MEMBERS

RELATED APPLICATIONS

The present application claims priority to U.S. Provisional Patent Application Ser. No. 61/409,287 titled BALL BAT INCLUDING A BARREL PORTION HAVING SEPARATE PROXIMAL AND DISTAL MEMBERS, and filed on Nov. 2, 2010. The present application is related to co-pending U.S. patent application Ser. Nos. 12/980,642 and 12/980/654, each filed on the same day herewith by Sean S. Epling, Mark A. Fritzke and Ty B. Goodwin and each entitled BALL BAT INCLUDING A BARREL PORTION HAVING SEPARATE PROXIMAL AND DISTAL MEMBERS, the full disclosure of which are hereby incorporated by reference.

FIELD OF THE INVENTION

The present invention relates to a ball bat including a handle portion and a barrel portion wherein the barrel portion is formed of separate proximal and distal members.

BACKGROUND OF THE INVENTION

Baseball and softball organizations periodically publish and update equipment standards and/or requirements including performance limitations for ball bats. It is not uncommon for ball bat manufacturers to adjust the design and/or construction of their ball bats to ensure that such bats satisfy the new or updated standards. In many instances, the challenge is to develop designs that fully satisfy such standards, while providing the player with beneficial characteristics, such as exception feel, consistency, reliability and performance.

One recently issued standard is the Bat-Ball Coefficient of Restitution ("BBCOR") Standard adopted by the National Collegiate Athletic Association ("NCAA") in 2009. The BBCOR Standard, which becomes effective on Jan. 1, 2011, is a principal part of the NCAA's effort, using available scientific data, to maintain as nearly as possible wood-like baseball bat performance in non-wood baseball bats.

Wood ball bats provide many beneficial features, however, they are prone to failure, and because wooden ball bats are typically solid, wooden bats can be too heavy for younger players even at reduced bat lengths. Accordingly, there is a need to produce a ball bat that shares many of the beneficial characteristics of wood bats without the negative characteristics, such as, durability, weight, design flexibility, etc. Non-wood bats provide greater design flexibility and are more reliable and durable than wood bats. Non-wood bats include bats formed of aluminum, other alloys, composite fiber materials, thermoplastic materials and combinations thereof.

The BBCOR Standard adopted by the NCAA is believed to eliminate discrepancies with different bat lengths and is intended to be a more direct measure of bat performance. The NCAA Rules Committee determined, based on a large sample of wood bats tested, that an appropriate maximum value under the BBCOR standard is 0.500. The 0.500 BBCOR performance limit is just slightly higher than the best available wood bats in the NCAA database.

Many baseball bats currently in the market are not designed or produced to meet the BBCOR Standard including the 0.500 BBCOR bat performance limit. Accordingly, a need exists for baseball bat constructions that can meet the BBCOR Standard including 0.500 BBCOR performance limit while retaining acceptable playability characteristics for players, including durability, feel, weight, etc. There is also a need for a baseball bat construction that optimizes the performance of the bat under the BBCOR Standard and the 0.500 performance limit.

In 2002, DeMarini introduced its Half-n-Half™ line of softball and baseball bats that decoupled the handle portion and barrel portions of the bat. The DeMarini Half-n-Half™ construction, as described in U.S. Pat. Nos. 6,702,698, 6,743,127, 6,945,886, 7,097,578 and 7,410,433, greatly enhanced ball bat design flexibility enabling the handle and barrel portions of ball bats to be specifically tailored for particular applications, player types and/or desired performance. The construction of the handle portion and barrel portions could be formed of entirely different constructions and each optimized for the desired performance characteristics.

It would be desirably to develop a ball bat that builds on the DeMarini® Half-n-Half™ model enabling even greater ball bat design flexibility and optimization.

SUMMARY OF THE INVENTION

The present invention provides a ball bat extending about a longitudinal axis. The bat includes a handle portion and a barrel portion. The barrel portion has an outer surface and includes a proximal member and a distal member. The proximal member has first and second end regions and the distal member has third and fourth end regions. The first end region is coupled to the handle portion and the second end region of the proximal member is coupled to the third end region of the distal member. The fourth end region of the distal member coupled to an end cap. At least a portion of each of the proximal and distal members defines the outer surface of the barrel portion. One of the second and third end regions overlapping the other of the second and third end regions.

According to a principal aspect of a preferred form of the invention, a ball bat extending along a longitudinal axis. The bat includes a tubular bat frame that includes first and second frame pieces. The first frame piece has a gripping portion integrally formed to a transition portion. The transition portion has a distal end region. The second frame piece has a proximal end region. The distal end region of the first piece is coupled to the proximal end region of the second piece. One of the distal and proximal end regions overlaps the other of the distal and proximal end regions. The bat has a center of percussion, and the mid-length of the overlap of the distal and proximal end regions is positioned within plus or minus three inches of the center of percussion of the bat.

According to another preferred aspect of the invention, a ball bat includes a handle portion and a barrel portion. The barrel portion has an outer surface and includes a proximal member and a distal member. The proximal member has first and second end regions and the distal member has third and fourth end regions. The first end region is coupled to the handle portion, the second end region of the proximal member is coupled to the third end region of the distal member, and the fourth end region of the distal member is coupled to an end cap. The proximal and distal members are formed of first and second materials, respectively. The second material is a fiber composite material. The second fiber composite material of the distal member is co-molded to the outer surface of the second end region of the proximal member.

This invention will become more fully understood from the following detailed description, taken in conjunction with the accompanying drawings described herein below, and wherein like reference numerals refer to like parts.

DETAILED DESCRIPTION OF THE INVENTION

Figure 1:
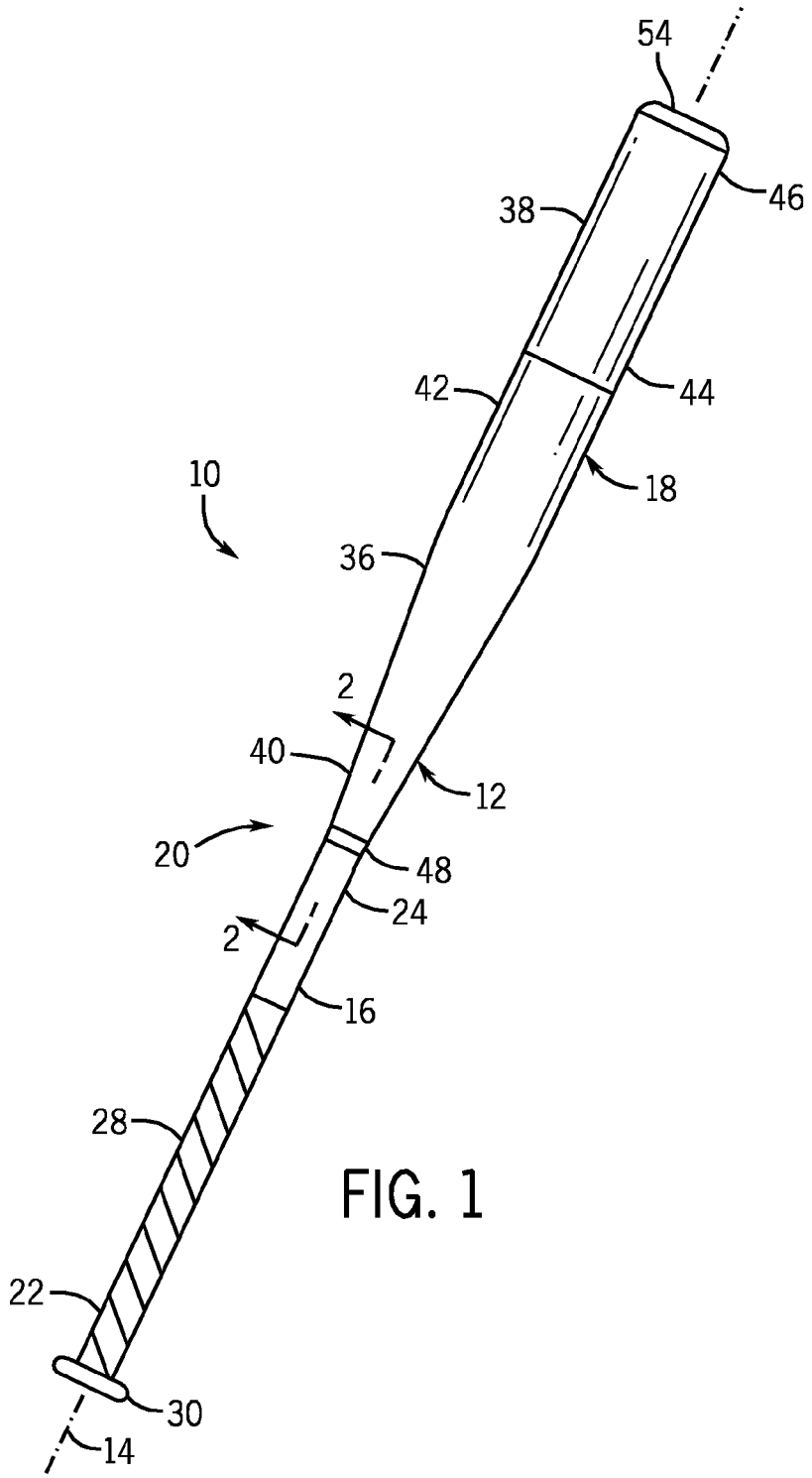
FIG. 1 is a side view of a ball bat in accordance with a preferred embodiment of the present invention.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches. One preferred embodiment of the present invention, the length of the bat frame is at least 30 inches.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material.

Figure 2A:
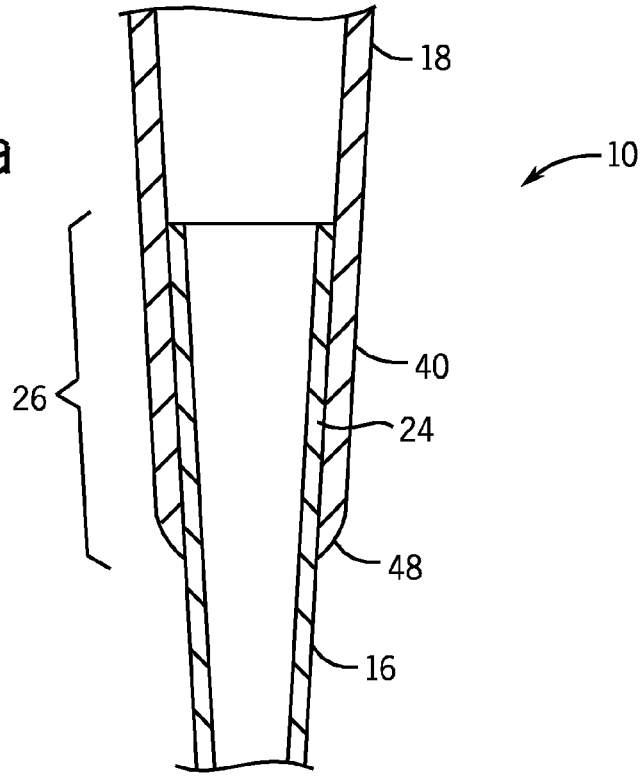
FIG. 2*a* is a longitudinal cross-sectional view of the coupling of a handle portion and a barrel portion of the bat taken along line 2-2 of FIG. 1.

The handle portion 16 is an elongate structure having a proximal end region 22 and a distal end region 24, which extends along, and diverges outwardly from, the axis 14 outwardly projecting from and along the axis 14 to form a substantially frusto-conical shape for connecting or coupling to the barrel portion 18. Referring to FIGS. 1 and 2*a*, the engagement of the distal end region 24 of the handle portion 16 to the barrel portion 18 is illustrated. The frusto-conical shaped distal end region 24 is preferably telescopically engaged with the barrel portion 18. A portion of the barrel portion 18 overlaps the distal end region 24 of the handle portion 16 to form a second overlap region 26. Preferably, the handle portion 16 is sized for gripping by the user and includes a grip 28, which is wrapped around and extends longitudinally along the handle portion 16, and a knob 30 connected to the proximal end 22 of the handle portion 16. The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

As used herein, the terms "composite material" or "fiber composite material" refer to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions (or angles) with respect to the longitudinal axis 14 including 0 degrees, 90 degrees and angular positions between 0 to 90 degrees, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

Figure 3:
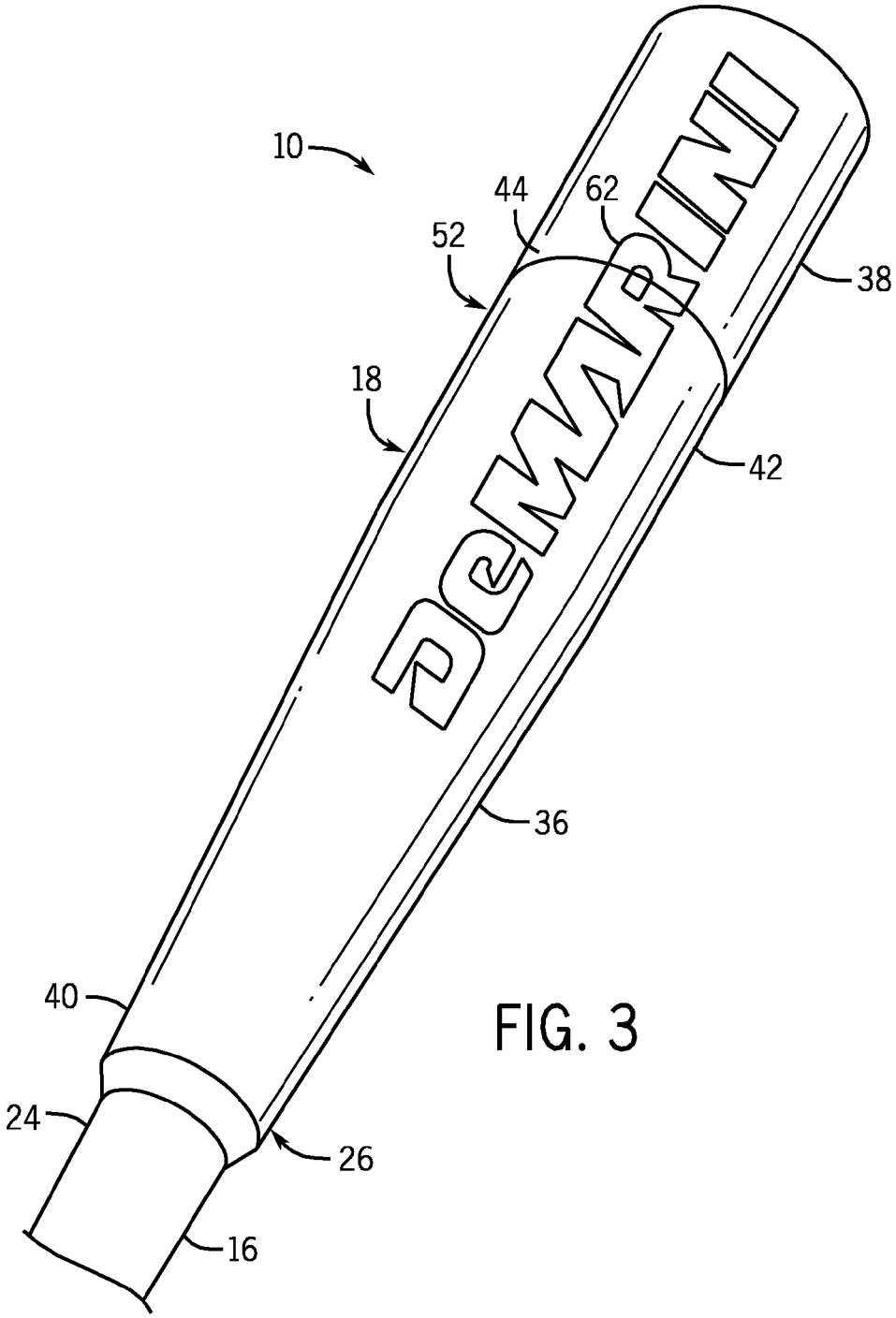
FIG. 3 is a side perspective view of the barrel portion of the ball bat of FIG. 1.
Figure 4:
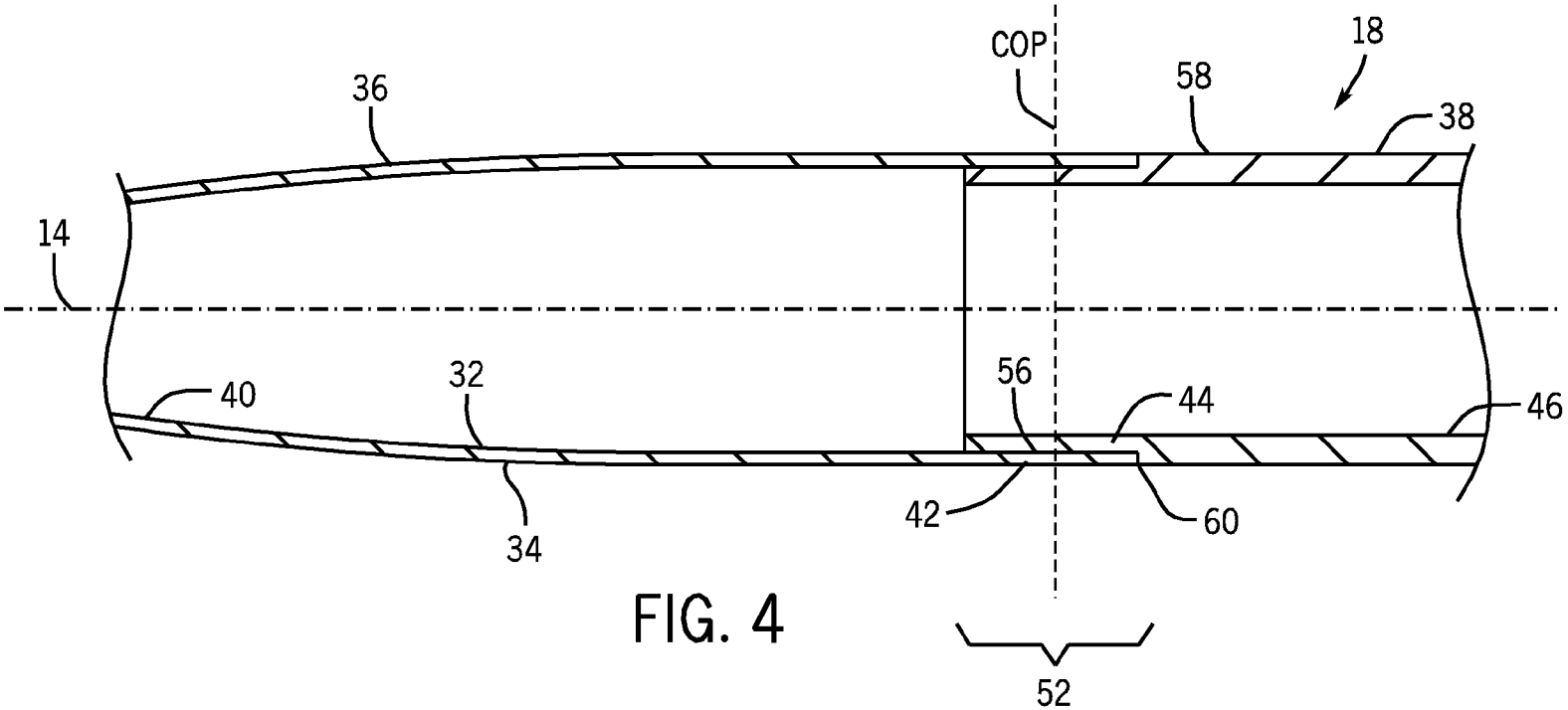
FIG. 4 is a longitudinal cross-sectional view of the barrel portion of the bat of FIG. 1.

Referring to FIGS. 1, 3 and 4, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has an inner surface 32 and an outer surface 34. The barrel portion 18 includes a proximal member 36 and a distal member 38. The proximal member 36 has first and second end regions 40 and 42, and the distal member 38 has third and fourth end regions 44 and 46.

The proximal member 36 is a hollow, tubular body having a shape that generally diverges from the axis 14 from the first end region 40 toward the second end region 42 with portions of the proximal member 36 having a uniform outside diameter along the longitudinal axis 14. Alternatively, other hollow, tubular shapes can also be used. The proximal member 36 is preferably formed of strong, durable and resilient material, such as, an aluminum alloy. In alternative preferred embodiments, the proximal member 36 can be formed of one or more composite materials, a titanium alloy, a scandium alloy, steel, other alloys, a thermoplastic material, a thermoset material, wood or combinations thereof.

Referring to FIGS. 1-2*a*, when considered from a direction along the axis 14 from the second end region 42 toward the first end region 40, the first end region 40 generally converges toward the axis 14 to form a frusto-conical shape that is complementary to the shape of the distal end region 24 of the handle portion 16. The first end region 40 of the barrel portion 18 can be directly connected to the handle portion 16 forming the second overlap region 26. The term directly connected can include connection with an adhesive such that some direct contact exists between the distal end region 24 and the first end region 40. Directly connected can include other connection methods including telescoping mechanical connection, threaded connections, interacting ridges or ribs, and other similar rigid connections. The second overlap region 26 can extend over a portion, or substantially all, of the distal end region 24 of the handle portion 16 and the first end region 40 of the proximal member 36. The configuration of the distal end region 24 and the first end region 40 results in a telescopic interlocking mechanical engagement at the second overlap region 26. This engagement further strengthens or supports the connection of the distal end region 24 and the first end region 40. The transition of the first end region 40 to the distal end region 24 typically results in a transitional edge 48 at the first end region 40. The transitional edge 48 can be chamfered, rounded, angled and can extend over a short length of 0.125 inches or a longer length.

Figure 2B:
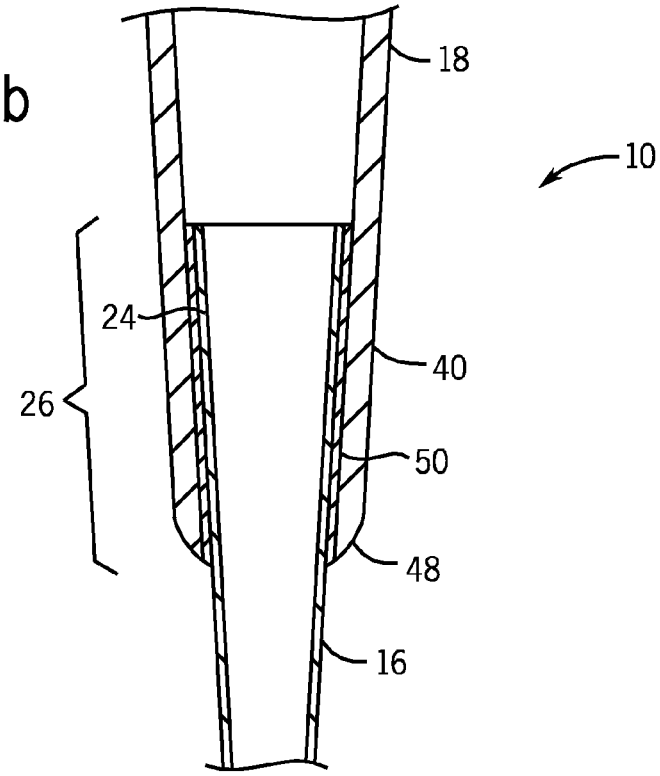
FIG. 2*b* is longitudinal cross-sectional view of the coupling of the handle portion of the bat to the barrel portion of the bat in accordance with an alternative preferred embodiment of the present invention.

Referring to FIG. 2*b*, in an alternative preferred embodiment an intermediate member 50 can be used to space apart and/or attach the handle portion 16 to the proximal member 36 of the barrel portion 18 at the second overlap region 26. The intermediate member 50 can space apart all or a portion of the barrel portion 16 from the handle portion 16, and it can be formed of an elastomeric material, an epoxy, an adhesive, a plastic, a metal and combinations thereof. In one particularly preferred embodiment, the distal end region 24 of the handle portion 16 can be formed with a plurality of ribs or projections that provide points or areas of contact between the handle and barrel portions 16 and 18, and the intermediate member 50 can be positioned between or among the points or areas of contact.

Figure 5:
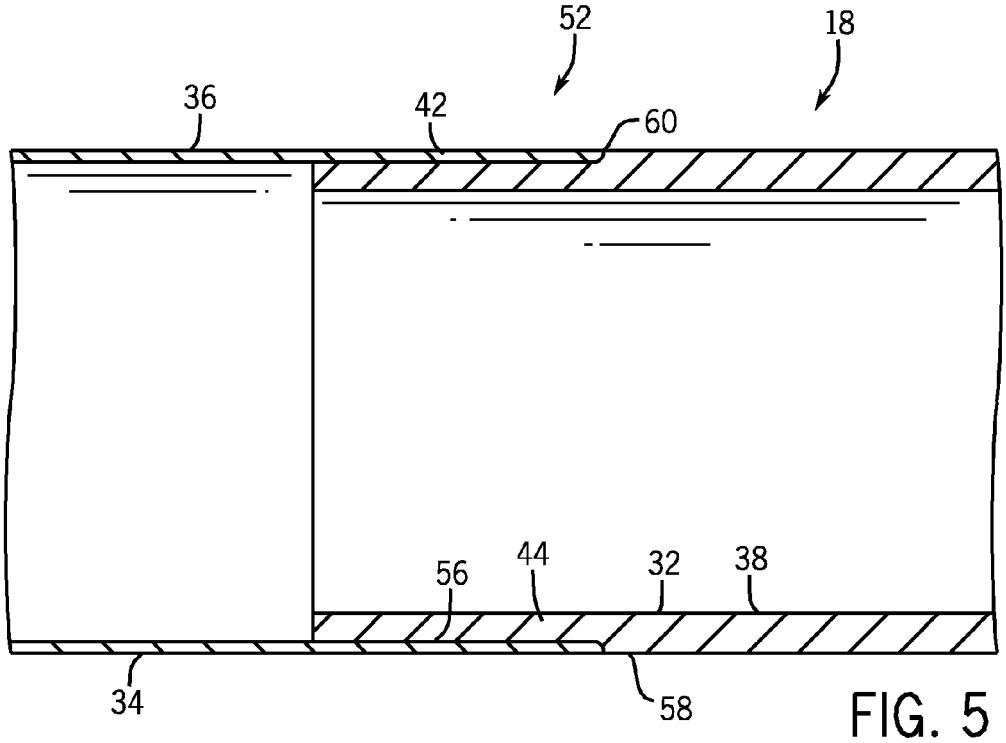
FIG. 5 is an enlarged longitudinal cross-sectional view of the coupling of a proximal member and a distal member of the barrel portion of the bat of FIG. 1.

Referring to FIGS. 3-5, the second end region 42 of the proximal member 36 is coupled to the third end region 44 of the distal member 38. In one preferred embodiment, the second end region 42 extends over the third end region 44 to form a first overlap region 52. Preferably, the second end region 42 is bonded to the third end region 44 of the distal member 38 by an adhesive, such as a toughened epoxy adhesive. Alternatively, other adhesives or bonding agents can be used to connect the second end region 42 to the third end region 44.

The second end region 42 preferably extends about the longitudinal axis 14 such that the first overlap region 52 is positioned at the center of percussion ("COP") of the bat 10. The COP is also known as the center of oscillation or the length of a simple pendulum with the same period as a physical pendulum as in a bat oscillating on a pivot. The COP is often used synonymously with the term "sweet spot." In alternative preferred embodiments, the first overlap region 52 can be positioned at a location that is longitudinally spaced apart from the COP. In particular, the mid-length position of the first overlap region 52 can be positioned within three inches of the COP. In other words, the barrel portion 18 can be configured such that the mid-length position of the first overlap region can be located at the longitudinal position of the COP of the bat 10 or within an area that longitudinally extends three inches proximally, and three inches distally, from the COP.

The first overlap region 52 preferably has a length along the axis 14 within the range of 0.1 to 7.0 inches. In one particularly preferred embodiment, the length of the first overlap region 52 is within the range 1.0 to 2.5 inches. The second end region 42 preferably does not extend to the fourth end region 46 of the distal member 38, and the third end region 44 preferably does not extend to the first end region 40 of the proximal member 36. The center of the length (or the mid-length) of the first overlap region 52 is preferably positioned to be within the range of 5.0 to 9.0 inches from the distal end of the bat 10 (or the distal end of the fourth end region 46 of the distal member 38). The second end region 42 can be formed to maintain a generally constant wall thickness along its length including at the first overlap region 52. Alternatively, the wall thickness of the second end region 42 can vary along its length or a portion of its length.

The distal member 38 is a hollow, tubular body having a cylindrical shape. Alternatively, other hollow, tubular shapes can also be used. The distal member 38 is preferably formed of strong, durable and resilient material, such as, a composite material. In alternative preferred embodiments, the proximal member 36 can be formed of an aluminum alloy, a titanium alloy, a scandium alloy, steel, other alloys, a thermoplastic material, a thermoset material, wood or combinations thereof. Accordingly, in a preferred embodiment, the barrel portion 18 is a tubular body formed of the proximal and distal members 36 and 38 and is entirely hollow without tie rods and other structure within the tubular body of the barrel portion 18. In alternative preferred embodiments, at least part of one or both of the distal and proximal members can be non-hollow or solid.

The handle portion 16 is formed of a first material, the proximal member 36 is formed of a second material, and the distal member 38 is formed of a third material. In one preferred embodiment, the first, second and third materials are different from each other. For example, in one particularly preferred embodiment, the first material can be a composite material with a composition and lay-up that provides increased flexibility, the second material can be an aluminum alloy, and the third material can be another composite material having a different composition and lay-up that provide greater durability and impact resistance. Other preferred embodiments other configurations and combinations of three different materials can be used. In another alternative preferred embodiment, two of the first, second and third materials are substantially the same material and the remaining of the first, second and third materials is different from other two. In yet another alternative preferred embodiment, the first, second and third materials can be formed of substantially the same material. For example, the same composite fiber material can be used with the same or different lay-up and fiber orientations.

Referring to FIG. 1, the fourth end region 46 is coupled to an end cap 54 (FIG. 1). The end cap 54 substantially encloses the bat 10 at the fourth end region 46. In one preferred embodiment, the end cap 54 is bonded to the fourth end region 46 through an epoxy. Alternatively, the end cap can be coupled to the fourth end region through other adhesives, chemical bonding, thermal bonding, an interference fit, other press-fit connections and combinations thereof.

Referring to FIGS. 3-5, the distal member 38 is coupled to the proximal member 36 at the third end region 44 which is overlapped by the second end region 42. In one preferred embodiment, the wall thickness of the distal member 38 varies over its length. The wall thickness of the distal member 38 away from the third end region 44 is generally constant over the remaining length of the distal member 38, and the wall thickness of the distal member 38 at the second end region 42 is reduced at the first overlap region 52. An annular recess 56 can be formed into an outer surface 58 of the distal member 38 to accommodate and engage the second end region 42 of the proximal member 36. In this manner, the total wall thickness of the barrel portion 18 remains generally constant over the length of the distal member 38 because the wall thickness of the second end region 42 overlapping the third end region 44 at the first overlap region 52 is approximately the same as the wall thickness of the distal member 38 away from the third end region 44.

The outside diameter of the barrel portion 18 remains substantially uniform or substantially constant along the length of the first overlap region 52 and the locations adjacent to the first overlap region 52. Preferably, the outside diameter of barrel portion 18 varies by less than 0.090 inch per inch of length along the barrel portion 18 at the first overlap region 52 and the locations adjacent thereto. Accordingly, the second overlap region 52 preferably does not form or result in a step or transitional edge projecting outward at the transition from the proximal member 36 to the distal member 38. A small seam 60 can be formed at the transition of the proximal and distal members 36 and 38. The seam 60 can be retained to highlight the two piece construction of the barrel portion 18. Alternatively, the application of a plurality of coatings 62, such as paint, clear coats, graphics, trademarks and other indicia can fill in imperfections on the outer surface 36 of the barrel portion 18 including the seam 60 and/or to make the transition between the proximal member 36 to the distal member 38 appear seamless.

In one preferred embodiment, the proximal and distal members 36 and 38 each represent at least 30 percent of the outer surface 34 of the barrel portion 18. In another preferred embodiment, each of the proximal and distal members 36 and 38 represent at least 40 percent of the outer surface 34 of the barrel portion 18.

The bat 10 built in accordance with the present invention can be configured to meet the NCAA Standard for Testing Baseball Bat Performance and to provide a maximum BBCOR value of less than or equal to 0.500. The barrel portion 18 including the first overlap region 52 provides greater design flexibility and enables the barrel portion 18 to be specifically tailored for compliance with the 0.500 maximum BBCOR value and to maintain optimal performance over a greater impact area of the barrel portion 18. The balance point, moment of inertia and the COP of the bat 10, and of baseball and softball bats generally, can be determined using the ASTM Standard F2398-04 entitled *Standard Test Method for Measuring Moment of Inertia and Center of Percussion of a Baseball or Softball Bat*. The balance point, BP, is the distance to the center of mass of a ball bat measured from the distal end of the bat knob. As stated above, the COP, is also known as the center of oscillation or the length of a simple pendulum with the same period as a physical pendulum as in a bat oscillating on a pivot. The Moment of Inertia, MOI, is a measure of mass distribution relative to an axis of rotation. MOI is the product of the mass multiplied by the square of the distance to the mass, summed over the entire bat. The COP and the MOI are measured about a pivot point (or an axis perpendicular to the longitudinal axis 14 of the bat) positioned six inches from the base or outer proximal surface of the knob 28 of the bat 10. If calculated in accordance with ASTM Std. F-2398-04, MOI can be calculated as follows, wherein Bat Weight is W.

$$MOI = W*(BP-6.0)*COP$$

The NCAA adopted the BBCOR protocol or standard for certifying bats for use in NCAA baseball games. The NCAA requires BBCOR certification for all bat constructions that are produced from materials other than one-piece solid wood. Each length and weight class of a bat model must be tested. The BBCOR test protocol is based upon ASTM F2219, *Standard Test Methods for Measuring High-Speed Bat Performance*, as modified by the NCAA BBCOR Protocol dated May 29, 2009. The current edition is ASTM F2219-09 published in July 2009. The BBCOR test protocol requires measuring and recording the MOI and BP of a bat according to ASTM F2398.

The NCAA BBCOR Standard provides a minimum MOI Rule specifying the minimum allowable MOI for associated length classes of ball bat models. For example, a 34 inch bat must have an MOI of at least 9530 oz-in$^2$, a 33 inch bat must have an MOI of at least 8538 oz-in$^2$, a 32 inch bat must have an MOI of at least 7630 oz-in$^2$, and a 31 inch bat must have an MOI of at least 6805 oz-in$^2$.

The present invention provides enhanced design flexibility allowing the proximal and distal members 36 and 38 to be made of different materials to enable the MOI of the performance of the barrel portion 18 of the bat 10 to be optimized for a particular application. A ball bat will often have its area of maximum performance at the COP or sweet spot of the bat. By placing the first overlap region 52 at or within three inches of the COP (COP plus or minus 3 inches), the areas of peak performance on the barrel can be optimized to satisfy the 0.500 limit of the BBCOR Standard. Alternatively, the bat of the present invention can be configured to satisfy other Industry standards apart from the NCAA BBCOR Standard.

Figure 6:
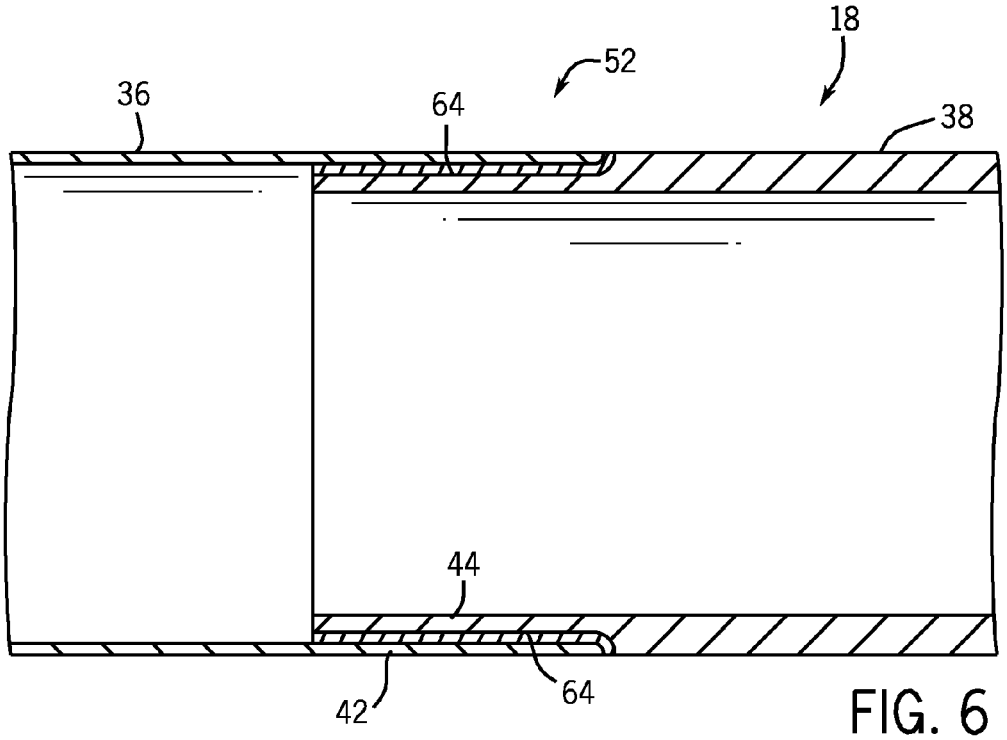
FIG. 6 is an enlarged longitudinal cross-sectional view of the coupling of the proximal member and the distal member of the barrel portion of the bat in accordance with an alternative preferred embodiment of the present invention.

Referring to FIG. 6, an alternative preferred embodiment of the present invention is illustrated. In particular, an engagement layer 64 can be positioned between the second end region 42 of the proximal member 36 and the third end region 44 of the distal member 38. The engagement layer 64 is formed of one or more layers of material. The material can be a thermoplastic material, a thermoset material, a metal or combinations thereof. The engagement layer 64 can be applied as one or more sheets of material, as a fluid that cures into a solid, or a combination thereof. The engagement layer 64 can be used to attach the second end region 42 to the third end region 44. The engagement 64 can be sized and constructed to entirely space apart the second and third end regions 42 and 44 such that no contact occurs between the second and third end regions 42 and 44. Alternatively, the engagement layer 64 can be used between the second and third end regions 42 and 44 and still allow some amount of contact between the second and third end regions 42 and 44. For example, outwardly projecting ribs or other projections can be formed on one or both of the second and third end regions 42 and 44 to provide some contact between the second and third end regions 42 and 44. The engagement layer 64 can be used to optimize the performance of the barrel portion at the first overlap region 52. Further, the engagement layer 64 can be used to dampen vibration and shock transmitted along the bat 10 in response to an impact with a ball. In another alternative embodiment, the engagement layer 64 can be used to enable relative movement between the second and third end regions 42 and 44. The engagement layer 64 can have a thickness within the range of 0.002 to 0.125 inches.

Figure 7:
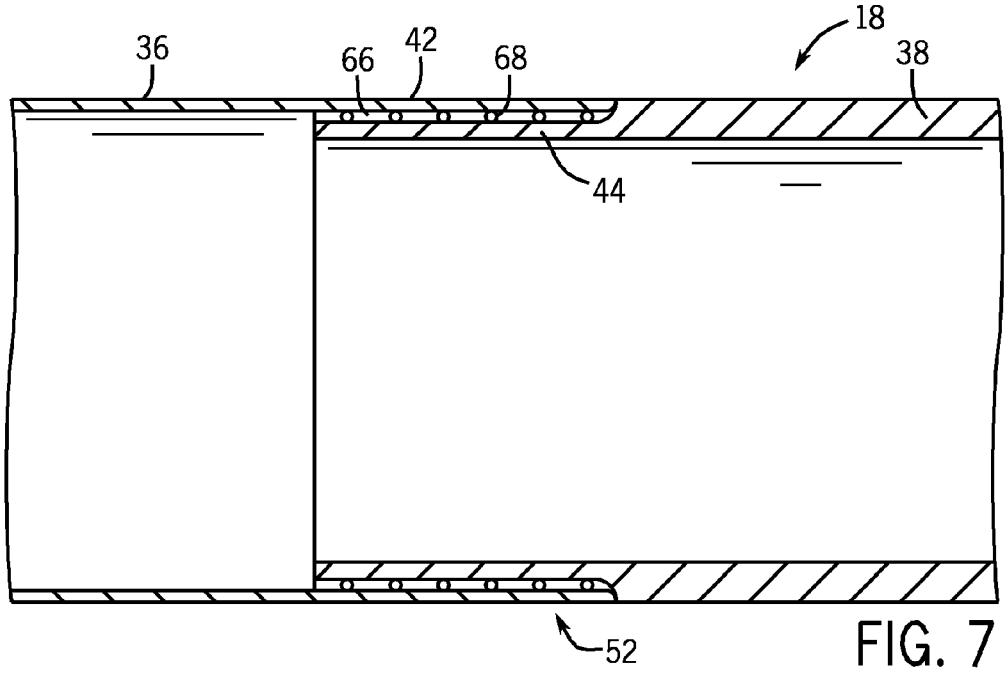
FIG. 7 is an enlarged longitudinal cross-sectional view of the coupling of the proximal member and the distal member of the barrel portion of the bat in accordance with an alternative preferred embodiment of the present invention.

Referring to FIG. 7, an alternative preferred embodiment of the present invention is illustrated. In particular, an adhesive layer 66 can be positioned between the second end region 42 of the proximal member 36 and the third end region 44 of the distal member 38. The adhesive layer 66 can include a plurality of beads 68 for aligning and spacing apart the second end region 42 from the third end region 44. The beads 68 can be glass shafting beads. The beads 68 are available in multiple sizes, such as 0.002 inch to 0.020 inch diameter. The beads 68 can be used to enhance the stiffness of a connection of the second and third end regions 42 and 44.

The adhesive layer 66 can also include a thermoplastic material, a thermoset material, or combinations thereof, upon which the beads 68 can be placed. The adhesive layer 66 can be sized and constructed entirely space apart the second and third end regions 42 and 44 such that no contact occurs between the second and third end regions 42 and 44. Alternatively, the adhesive layer 66 can be used between the second and third end regions 42 and 44 and still allow some amount of contact between the second and third end regions 42 and 44. The adhesive layer 66 can be used to optimize the performance of the barrel portion at the first overlap region 52. Alternatively, further the adhesive layer 66 can be used to dampen vibration and shock transmitted along the bat 10 in response to an impact with a ball. In another alternative embodiment, the adhesive layer 66 can be used to enable relative movement between the second and third end regions 42 and 44. The adhesive layer 66 can have a thickness within the range of 0.002 to 0.125 inch.

Figure 8:
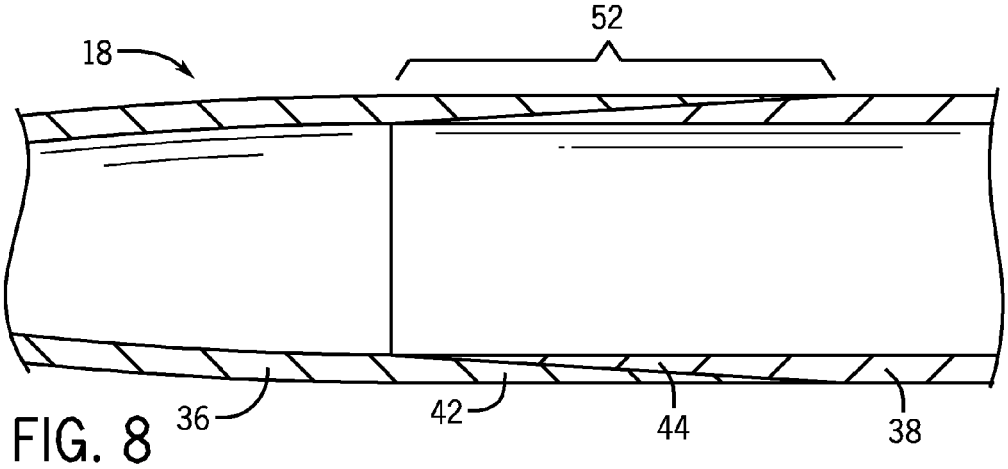
FIG. 8 is a longitudinal cross-sectional view of the barrel portion of the bat in accordance with an alternative preferred embodiment of the present invention.

Referring to FIG. 8, an alternative preferred embodiment of the present invention is illustrated. In particular, an alternative construction of the first overlap region 52 is illustrated. The transition and/or overlap of the second end region 42 of the proximal member 36 with the third end region 44 of the distal member 38 can occur over a greater length, such as approximately 7.0 inches, and can be gradual or tapered over the first overlap region 52. In this embodiment, the wall thickness of the barrel portion 18 at and adjacent to the first overlap region 52 remains generally constant along the length of the barrel portion 18. In particularly preferred embodiments, the length of the first overlap region 52 can extend within a range of approximately 5 to 95 percent of the length of the barrel portion 18.

Figure 9:
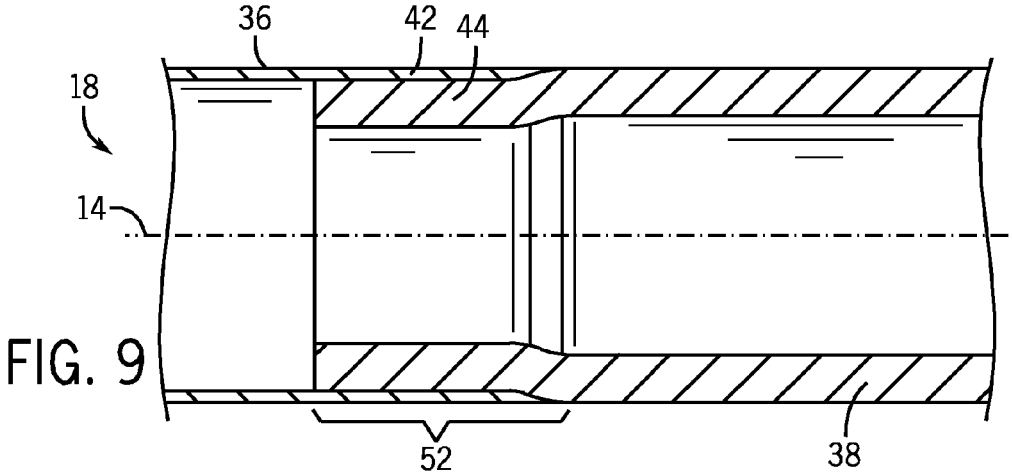
FIG. 9 is an enlarged longitudinal cross-sectional view of the coupling of the proximal member and the distal member of the barrel portion of the bat in accordance with an alternative preferred embodiment of the present invention.

Referring to FIG. 9, an alternative preferred embodiment of the present invention is illustrated. In particular, an alternative construction of the first overlap region 52 is illustrated. The wall thickness of the barrel portion 18 at the first overlap region 52 can be greater than the wall thickness of the barrel portion 18 at the other locations of the proximal member 36 and the distal member 38. The wall thickness of the proximal and distal members 36 and 38 can be generally constant along the length of the barrel portion 18 and the wall thickness of the barrel portion 18 at the first overlap region 52 can be the total of the wall thickness of the proximal and distal members 36 and 38. The outside diameter of the barrel portion 18 can be maintained as generally constant, or with a slight taper, along the length of the first overlap region 52 and locations adjacent thereto, while the inside diameter can vary at the first overlap region 52 such that the inside diameter of the barrel portion 18 is reduced by at 5 percent or more.

Figure 10:
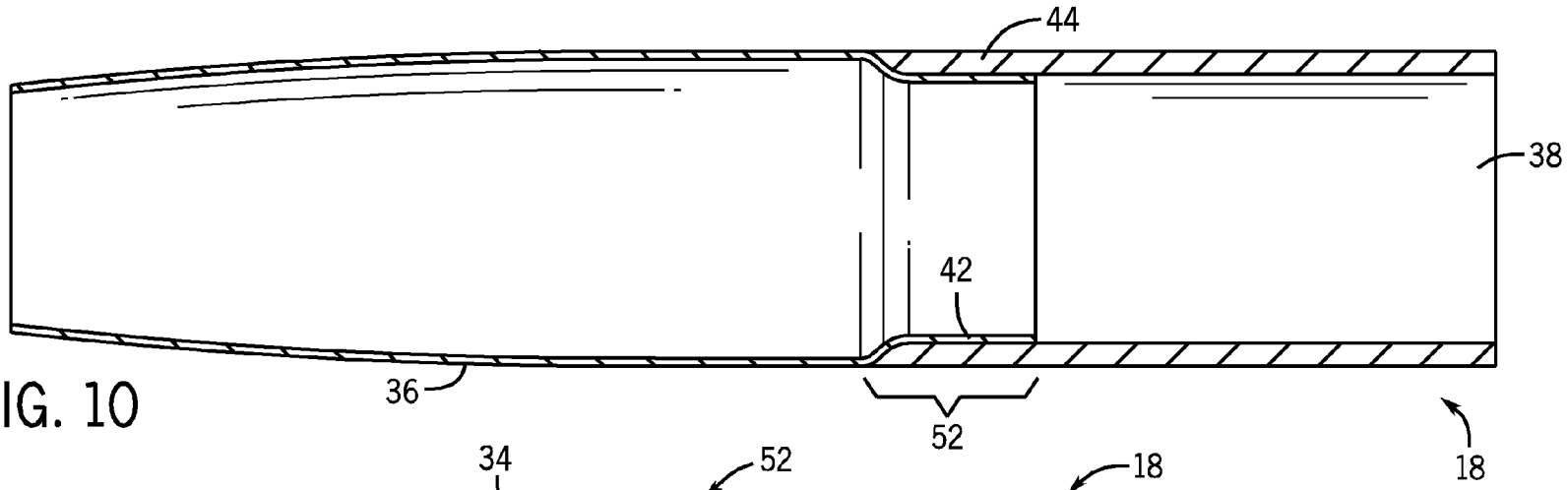
FIG. 10 is a longitudinal cross-sectional view of the barrel portion of the bat in accordance with an alternative preferred embodiment of the present invention.
Figure 11:
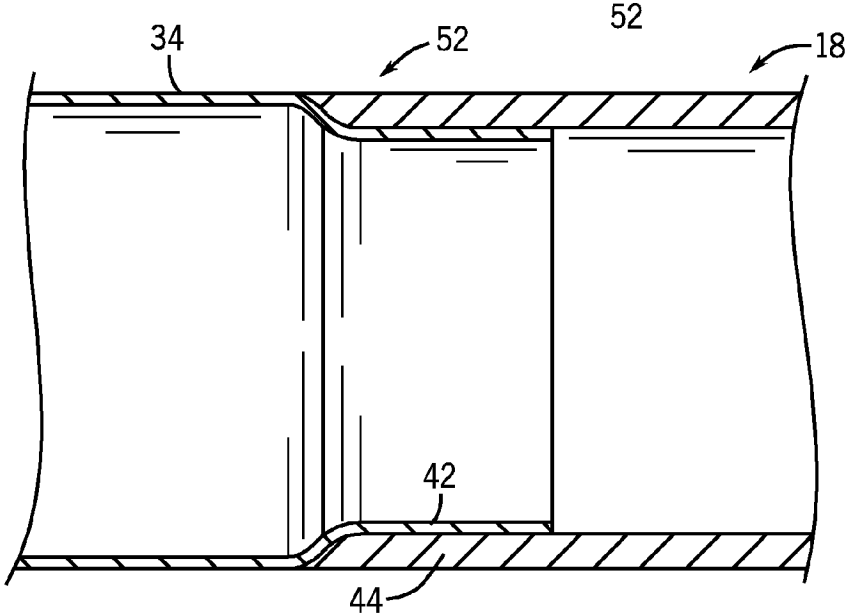
FIG. 11 is an enlarged longitudinal cross-sectional view of the coupling of the proximal member and the distal member of the barrel portion of FIG. 10.

Referring to FIGS. 10 and 11, another alternative preferred embodiment of the present invention is illustrated. The third end section 44 can overlap the second end section 42 to form the first overlap region 52. The diameter of the proximal member 36 can be reduced at the second end section 42 to accommodate the overlying third end section 44 of the distal member 38. The distal member 38 can be formed of a composite material that is formed over the second end section 42 to provide a smooth transition on the outer surface 34 of the barrel portion 18 between the proximal and distal members 36 and 38.

Figure 12:
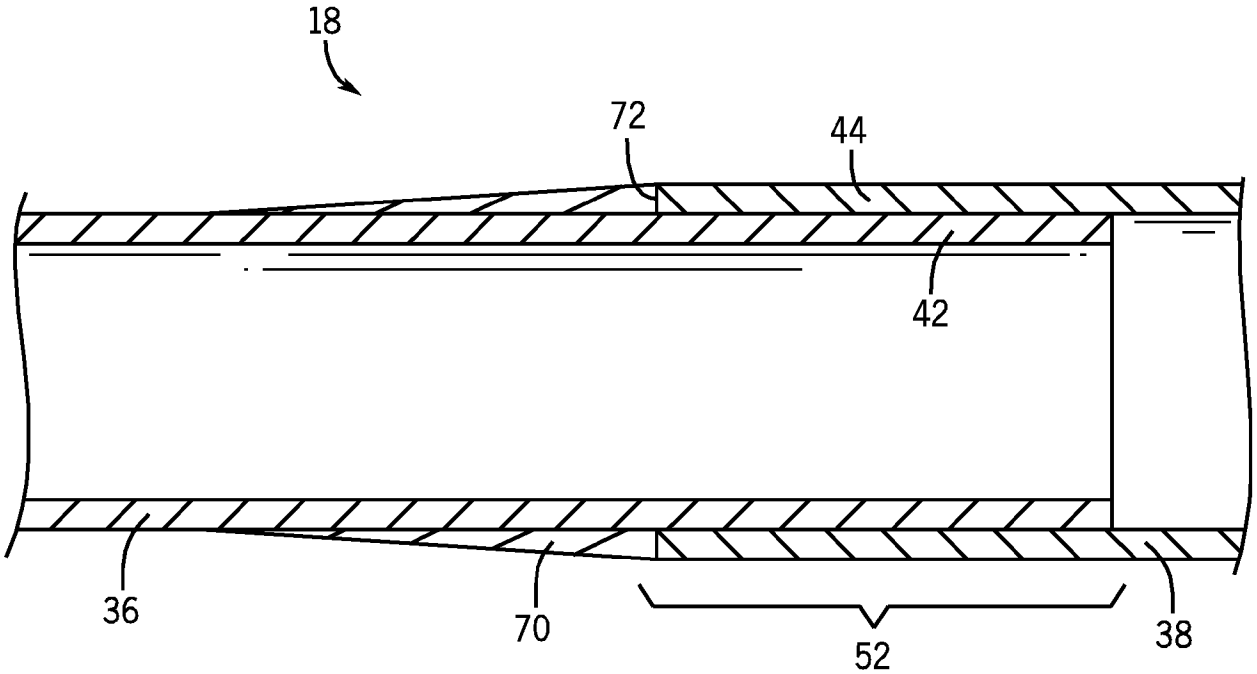
FIG. 12 is an enlarged longitudinal cross-sectional view of the coupling of the proximal member and the distal member of the barrel portion of the bat in accordance with an alternative preferred embodiment of the present invention.

Referring to FIG. 12, an alternative preferred embodiment of the present invention is illustrated. In particular, a transition element 70 can be applied to the barrel portion 18 to provide a smooth continuous surface or contour to the outer surface 34 of the barrel portion 18. The third end section 44 of the distal member 38 can overlap the second end section 42 of the proximal member 36 to form the first overlap region 52. Alternatively, the second end section 42 can overlap the third end section 44. If a transitional edge 72 is present due to the overlap, the transitional element 70 can be applied to the outer surface 34 of the barrel portion 18 to facilitate the transition between the proximal and distal members 36 and 38. The transitional element 70 can be formed of one or more pieces creating chamfered ring about barrel at the transitional edge 72. The transitional element 70 can be applied to the outer surface 34 of the barrel portion 18 through an adhesive, thermal bonding, compression molding or other conventional fastening means. The transitional element 70 is preferably formed of a durable material, such as a thermoset material. Alternatively, the transitional element 70 can be formed of other materials, such as, for example, a thermoplastic material, an epoxy, a metallic alloy, wood, a composite material and combinations thereof.

Figure 13:
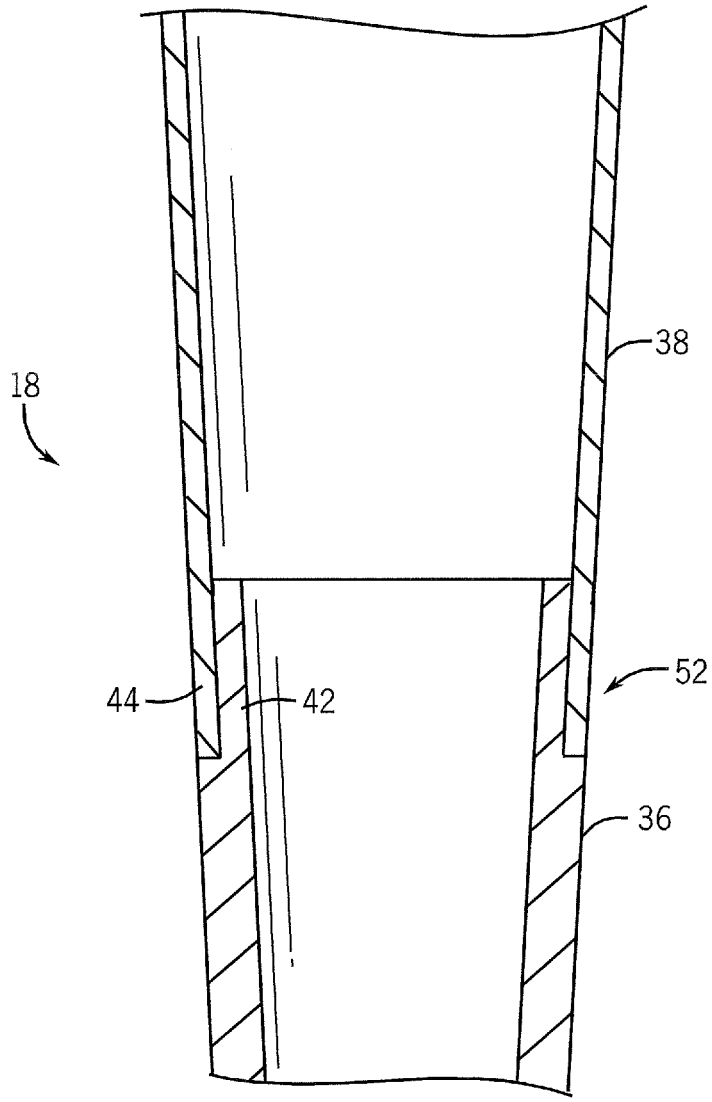
FIG. 13 is a longitudinal cross-sectional view of the barrel portion of the bat in accordance with another preferred embodiment of the present invention.

Referring to FIG. 13, in one preferred embodiment the second end region 42 of the proximal member 36 can be coupled to the third end region 44 of the distal member 38 such that telescopic engagement exists between the proximal and distal members 36 and 38. The telescoping engagement of the proximal and distal members 36 and 38 can be used to further strengthen the engagement of the members 36 and 38. Other fastening means can be used in addition to the telescopic engagement, such as, for example, thermal bonding and adhesive bonding.

Figure 14:
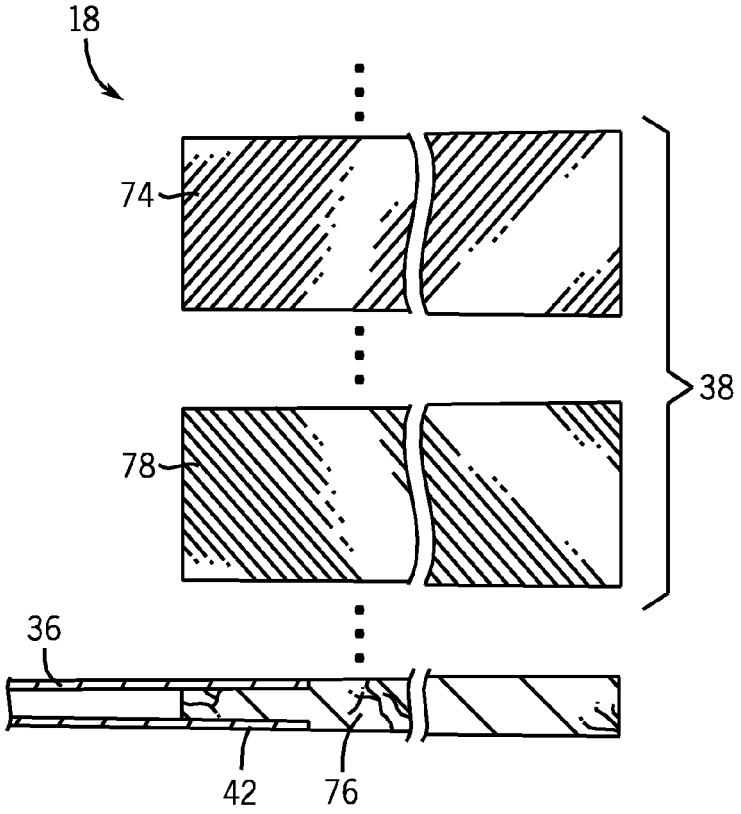
FIGS. 14 and 15 illustrate methods of co-molding the distal member and the proximal member to the proximal member and the distal member, respectively in accordance with alternative preferred methods and embodiments of the present invention.
Figure 15:
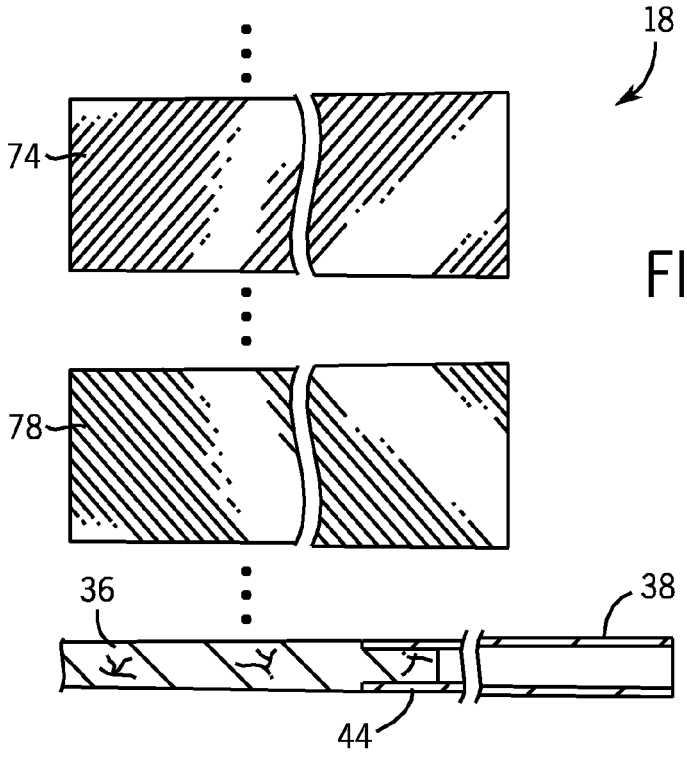

Referring to FIGS. 14 and 15, the proximal member 36 and/or the distal member 38 can be formed of a composite material. Referring to FIG. 14, the distal member 38 can be formed and co-molded, or secondarily molded, to the second end region 42 of the proximal member 36, or, as shown in FIG. 15, the proximal member 36 can be formed and co-molded to the third end region 44 of the distal member 38. With respect to the present invention, the term "co-molded" shall mean the wrapping and curing of at least a portion of one or more layers of composite material over a finished component of a product. In particular, co-molded refers to the wrapping and curing of one or more layers of composite material 74 over the second end region 42 of the proximal member 36 as shown in FIG. 14, or the third end region 44 of the distal member 38, as shown in FIG. 15. Co-molding provides an exceptional connection between the composite material and the applicable end region 42 or 44. Co-molding provides a more uniform and consistent bond-line than other connection types. The improved connection of the two components provided by co-molding improves the integrity and durability of the connection.

In one preferred embodiment, a mandrel 76 is configured to fit into the second end region 42 of the proximal member 36 and is shaped to define the inner surface of the distal member 38 excluding the first overlapped region 52. The outer surface of the second end region 42 can be roughened to enhance or improve the bonding or connection between the distal member 38 and the second end region 42. Alternatively, outer surface of the second end region 42 can be left un-roughened. The mandrel 76 can be formed of any material that maintains its shape and integrity during the curing process. Once the mandrel 76 is properly positioned, the process of "laying up" the layers comprising the composite material is performed. The inner surface of the distal member 38 is formed by wrapping the one or more layers of composite material directly over the second end region 42 of the proximal member 36 and the mandrel 76. In one particularly preferred embodiment, an innermost layer of the composite material 78 can be a galvanic corrosion inhibiting layer that can be wrapped about the outer surface of the second end region 42 and over at least a portion of the outer surface of mandrel 76. In other preferred embodiments, no galvanic corrosion inhibiting layer is used. Additional layers of composite material 74 can then be wrapped over the innermost layer 78 to form the distal member 38. The shape and overall size of the layers, such as layers 74 and 78, can vary from one to another. The lay-up including the proximal member 36, the mandrel 76 and the wrapped composite layers 74 and 78 are heated and cured to form the distal member 38. After curing, the mandrel 76 is removed from the inner surface of the distal member 38 through conventional means, such as, for example, extraction or heating.

Thus, in FIG. 14, the distal member 38 is preferably wrapped and formed over the proximal member 36 at the second end region 42 and co-molded to the proximal member 36 to form the barrel portion 18. Alternatively, as in FIG. 15, the proximal member 36 can be wrapped and formed over the distal member 38 at the third end region 44 and co-molded to the distal member 38 to form the barrel portion 18. In this process, the co-molded connection of the proximal and distal members 36 and 38 is formed without the use of separate adhesives. In alternative preferred embodiments, one or more separate adhesives can be used to facilitate the connection of the proximal and distal members 36 and 38.

In one particularly preferred method of forming the barrel portion 18, the proximal and distal members 36 and 38 can be formed of different second and third composite materials, respectively. The second composite material can be formed with a resin having a higher cure temperature, such as, for example, 350 degrees F., and the third composite material can be formed with a different resin having a lower cure temperature, such as, for example, 250 degrees F. With this configuration, the proximal member 36 can be formed and cured with a curing process at approximately 350 degrees F. Then, once formed and cured, the distal member 38 can be co-molded to the second end region 42 of the proximal member 36 in a manner as described above. However, the cure temperature of the co-curing process would be held at approximately 250 degrees F. to allow the resin of the third composite material to cure properly, but not close to the 350 degree F. temperature thereby allowing the second composite material having the 350 degree F. resin to remain intact during the approximate 250 degree F. curing process. Alternatively, the proximal member 36 can be formed of a different material such as an aluminum alloy and therefore the distal member 38 can be directly formed and co-molded to the proximal member 36 in the manner described above.

The co-molded connection of the proximal and distal members 36 and 38 assists in dampening unwanted shock and/or vibrational energy generated from impact of the bat with a ball as it extends up and along the shaft 12 to the user's hands. The transition from the dissimilar second and third materials at the first overlapped region 52 serves to dampen or lessen the severity of the shock and/or vibrational energy.

In alternative preferred embodiments and methods, the proximal and/or distal members 36 and 38 can be formed of a composite material and produced through an Oriented Polypropylene shrink wrap and table rolling ("OPP", filament winding, bladder molding or trapped rubber molding. OPP is a low cost approach that can also be domestically produced.

Figure 16:
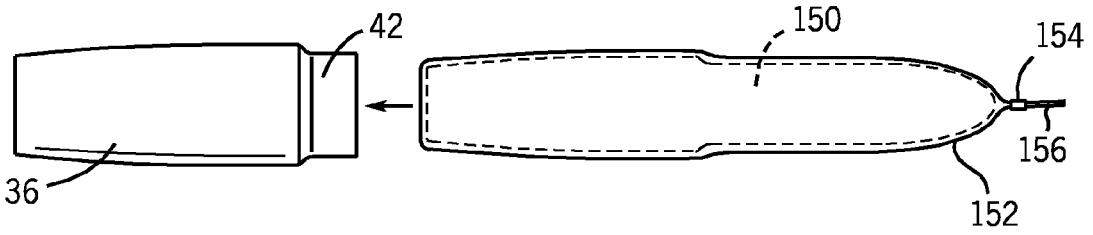
FIGS. 16-18 illustrate a method of co-molding a distal member to a proximal member to form a barrel portion in accordance with alternative preferred method of the present invention.
Figure 17:
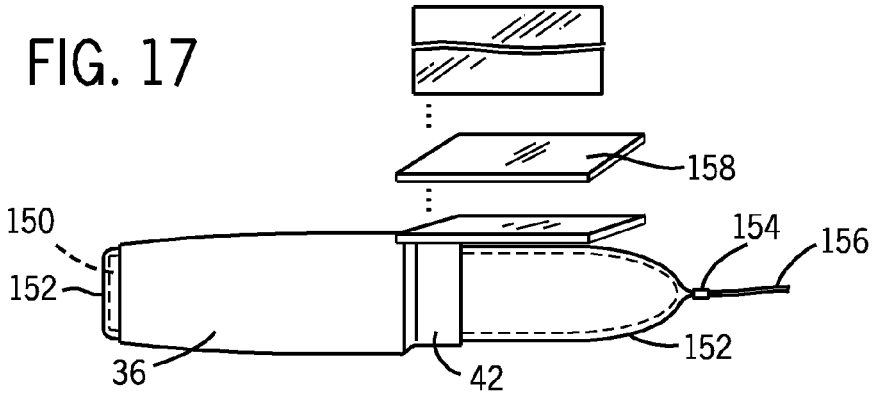
Figure 18:
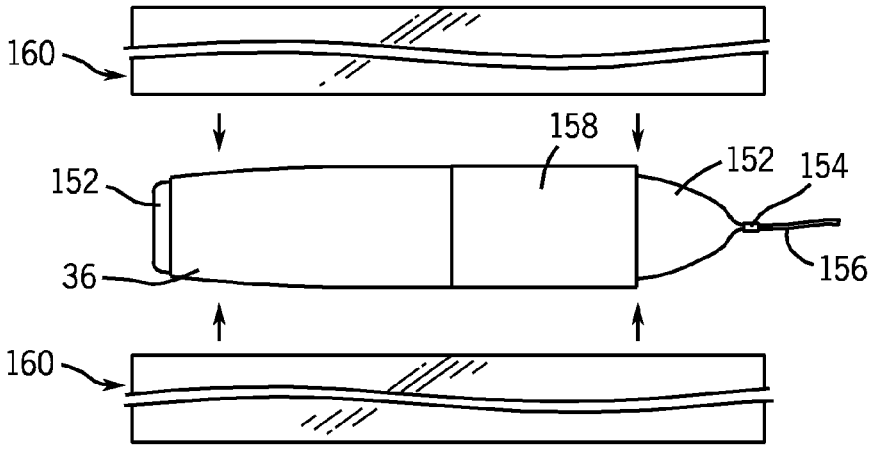

Referring to FIGS. 16-18, another alternative preferred embodiment and method of forming, and in particular co-molding, a barrel portion 18 in accordance with the present invention is illustrated. For example, the method of FIGS. 16-18 can be used to produce the barrel portion of FIG. 10. One of the proximal and/or distal members can be pre-formed or in a substantially finished condition. In FIGS. 16-18, the proximal member 36 is preformed. Referring to FIG. 16, a mandrel 150 shaped in a manner that generally conforms to the inner dimensions of the distal member 38 and at least part of the proximal member 36 is obtained. The outer surface of the second end region 42 can be roughened to enhance or improve the bonding or connection between the distal member 38 and the second end region 42. The mandrel 150 can be formed of any material that maintains its shape and integrity during the co-molding process. In one particularly preferred embodiment, the mandrel 150 is sized to extend throughout, and slightly beyond, the length of the proximal and distal members. In other preferred embodiments, a cap or stop can be used to position the mandrel only partially into the proximal member. A substantially airtight bladder 152 is positioned over the mandrel 150. The bladder 152 includes a valve 154 and a hose 156 connected to a high pressure source of air or other gas.

Referring to FIG. 17, the bladder 152 and mandrel 150 are positioned within the proximal member 36, and the process of "laying up" the layers 158 comprising the composite material is performed. The layers 158 are wrapped directly over the second end region 42 of the proximal member 36 and the bladder 152 extending from the distal end of the proximal member 36. The shape and overall size of the layers 158 can vary from one to another.

Referring to FIG. 18, the lay-up including the proximal member 36, the bladder 150, the mandrel 152 and the wrapped composite layers 158 are placed into a mold 160. The bladder 152 is pressurized through the hose 156 and the valve 154, and the lay-up is heated and cured to form the distal member 38 (FIG. 10). The bladder 152 is preferably pressurized with air within the range of 50-250 psi, and more preferably approximately 140 psi. The air pressure forces the bladder 152 to expand and press the layers 158 against the inner surfaces of the mold 160. The mold 160 heats the assembly or lay-up to the cure temperature of the particular layers 158, preferably within the range of 220 to 380 degrees F. After curing, the bladder 152 and the mandrel 150 are removed from the inner surface of the distal member 38 through conventional means, such as, for example, extraction or heating. The result is a barrel portion 18 that resembles the barrel portion of FIG. 10.

In other preferred embodiments and methods, the proximal or distal members can be formed using a bladder molding process or a resin transfer molding (RTM) process. In the bladder molding process, a mandrel is not used. Rather, a tube of material, such as a thermoplastic material is positioned partially within the other of the proximal or distal members, and within a mold. A bladder, similar to the bladder 150, is positioned within the tube of material and is pressurized thereby forcing the tube of material to the inner surface of the proximal or distal member and the mold to form the desired proximal or distal member. In the RTM process a matrix or fabric mesh can be placed within the mold and under heat and pressure a layer of resin flows throughout the matrix and cures to form the desired proximal or distal member.

Figure 19:
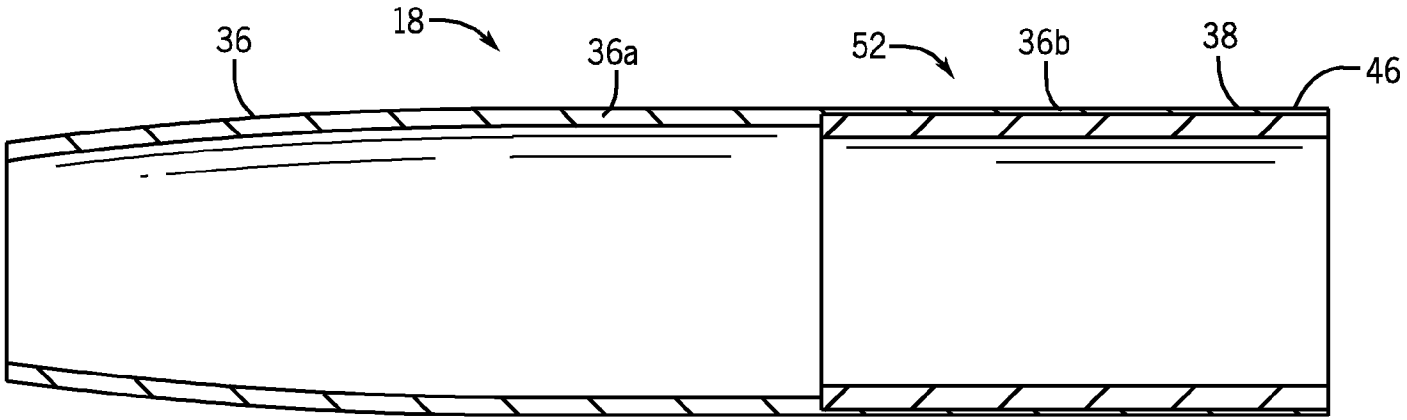
FIG. 19 is a longitudinal cross-sectional view of the barrel portion of the bat in accordance with another preferred embodiment of the present invention.

Referring to FIG. 19, another alternative preferred embodiment of the present invention is illustrated. The proximal member 36 can be formed with first and second parts 36*a* and 36*b*. The first part 36*a* being configured to provide to form the proximal part of the barrel portion 18. The second part 36*b* forms the first overlapped region 52. The second part 36*b* can be formed with a reduced wall thickness than 36*a* primarily because the second part 36*b* overlaps the distal member 38. The wall thickness of the second part 36*b* can be vary over its length or can have a generally uniform thickness. The wall thickness of the second part 36*b* can range from 0.002 to 0.100 inch. When the thickness of the second part 36*b* is on the lower end of the thickness range, the operation loads applied during use are substantially carried or supported by the distal end member 38. In this embodiment, the second part 36 allows for the outer surface of the barrel portion 18 to be formed without a seam, or allows for the seam to be repositioned toward the fourth end part 46 of the barrel portion 18. The second part 36*b* can extend the entire length of the distal member 38 as shown in FIG. 19, or the length of the second part 36*b* can extend over the distal member 38 by an amount that is less than the entire length of the distal member 38. For example. The second part 36*b* can extend over the distal member 38 but not the fourth end region 46 of the distal member 38. The second part 36*b* is preferably fixedly secured to the distal member 38 over the first overlap region 52. Alternatively, the second part 36*b* can be configured to slide or move relative to the distal member 38 upon impact with a ball. In these embodiments, an extended bond line can be formed between the inner surface of the second part 36*b* and the outer surface of the distal member 38. The bond line can be adjusted to optimize performance for a particular application.

Figure 20:
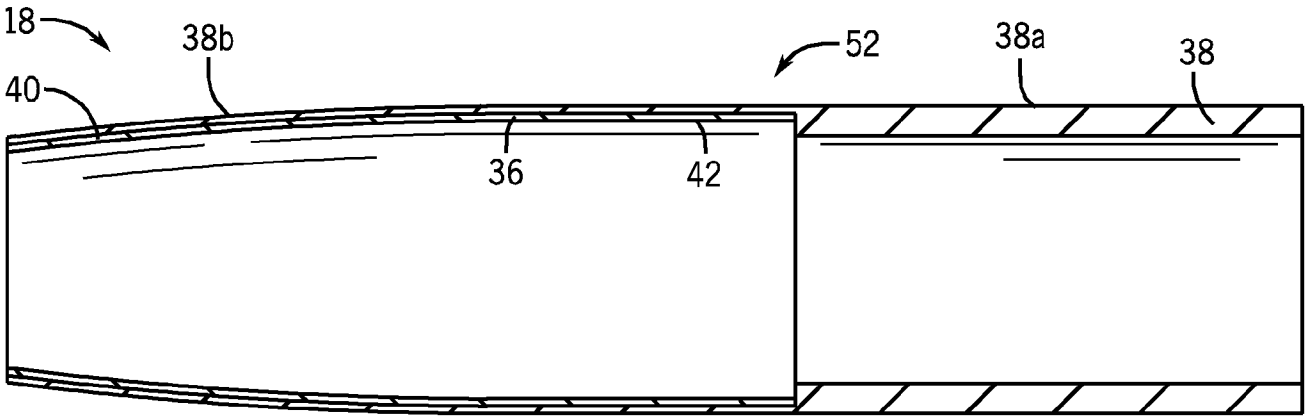
FIG. 20 is a longitudinal cross-sectional view of the barrel portion of the bat in accordance with another preferred embodiment of the present invention.

Referring to FIG. 20, another alternative preferred embodiment of the present invention is illustrated. The distal member 38 can be formed with first and second parts 38*a* and 38*b*. The first part 38*a* being configured to provide to form the distal part of the barrel portion 18. The second part 38*b* forms the first overlapped region 52. The second part 38*b* can be formed with a reduced wall thickness than 38*a*. The wall thickness of the second part 38*b* can vary over its length or can have a generally uniform thickness along its length. The wall thickness of the second part 38*b* can range from 0.002 to 0.100 inch. When the thickness of the second part 38*b* is on the lower end of the thickness range, the operational loads applied during use to proximal part of the barrel portion 18 are substantially carried or supported by the proximal member 36. In this embodiment, the second part 38*b* allows for the outer surface of the barrel portion 18 to be formed without a seam, or allows for the seam to be repositioned toward the first end region 40 of the barrel portion 18. The second part 38*b* can extend the entire length of the proximal member 38 as shown in FIG. 19, or the length of the second part 38*b* can extend over the proximal member 38 by an amount that is less than the entire length of the proximal member 38. For example. The second part 38*b* can extend over the proximal member 38 but not the fourth end region 46 of the distal member 38. The second part 38*b* is preferably fixedly secured to the proximal member 36 over the first overlap region 52. Alternatively, the second part 38*b* can be configured to slide or move relative to the proximal member 38 upon impact with a ball. In these embodiments, an extended bond line can be formed between the inner surface of the second part 38*b* and outer surface of the proximal member 38. The bond line can be adjusted to optimize performance for a particular application.

Figure 21:
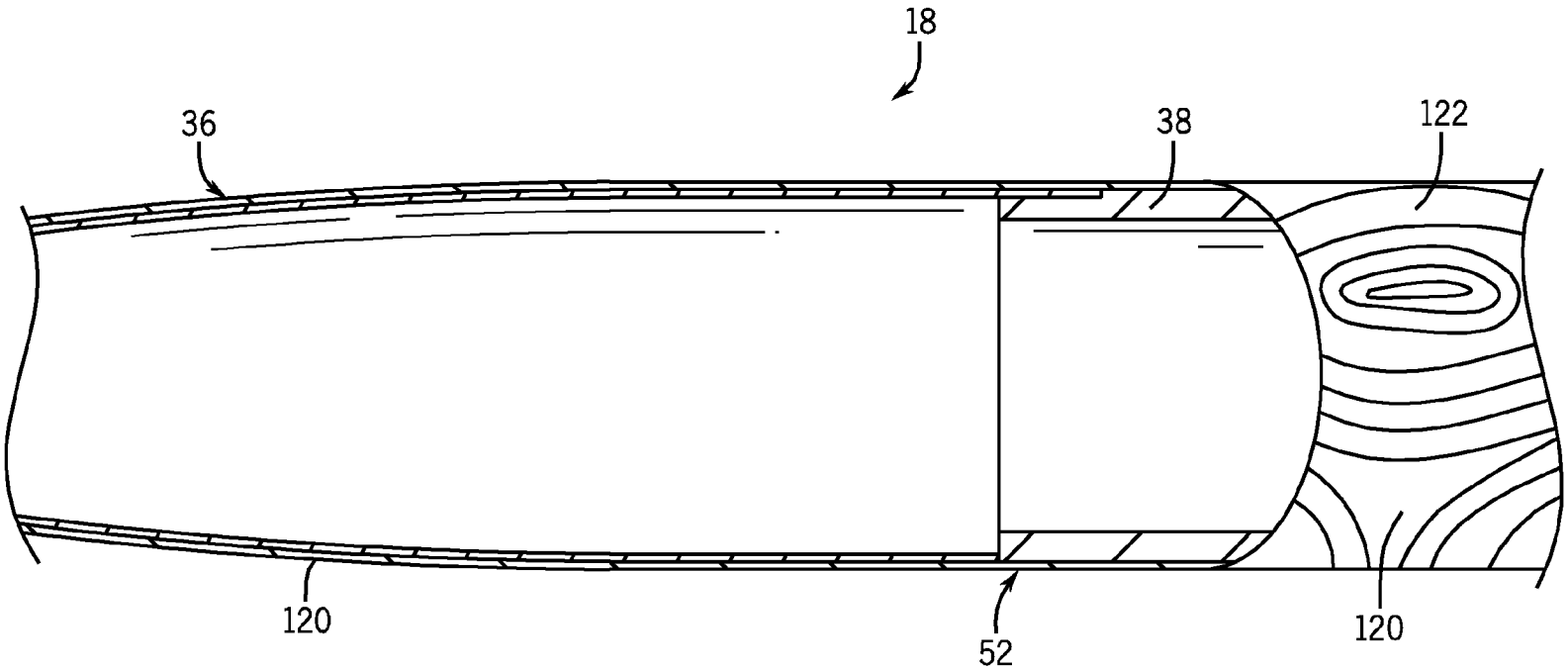
FIG. 21 is a side view of the barrel portion of the bat with part of the barrel portion shown in cross-section, in accordance with another preferred embodiment of the present invention.

Referring to FIG. 21, the barrel portion 18 can include an outer layer 120 that is applied over the outer surface of the proximal and distal members 36 and 38. The barrel portion 18 can be formed in accordance with any of the preferred embodiments described above, and under the embodiment of FIG. 21 the outer layer 120 can be applied over part or all of the barrel portion 18. For example, the outer layer 120 can extend over the entire barrel portion 18 as shown in FIG. 21, or it can extend over just the proximal member 36, just the distal member 38 or just the first overlap region 52 or portions of one or more of these areas. The outer layer 120 is preferably very thin, within the range of 0.001 to 0.030 inch. The outer layer 120 is preferably formed of durable material such as a thermoplastic material. Alternatively, the outer layer 120 can be formed of other materials, such as, for example, a wood, a thermoset material, a fiber composite material, a metallic foil, a rubber, a plastic, an acrylic, a ceramic, and combinations thereof. In other embodiments, the outer layer 120 can be transparent or translucent material. When the outer layer 120 is formed of a wood, such as a wood veneer, the outer layer 120 can provide the barrel the appearance of a wood barrel. The outer layer 120 can include an outer surface having alphanumeric and/or graphical indicia 122. The indicia 122 can be a graphical design, a pattern, a logo, a trademark, an instruction and combinations thereof. The outer layer 120 can be used to cover any seam that may be present on the outer surface of the proximal and/or distal members 36 and 38 due to the first overlap region 52.

Figure 22:
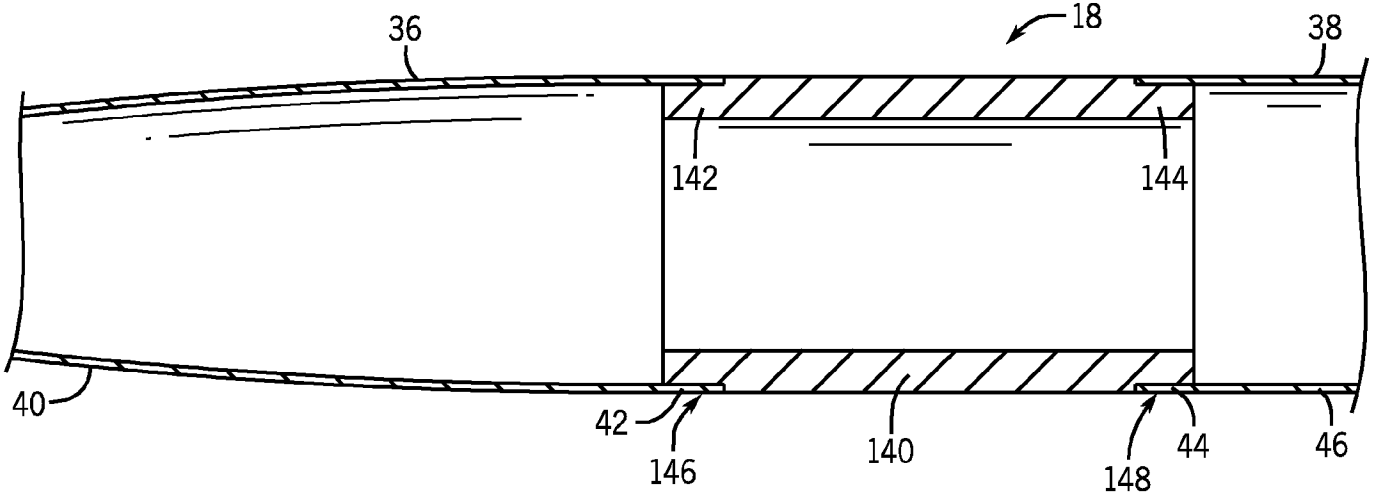
FIGS. 22 and 23 are longitudinal cross-sectional views of the barrel portion of the bat in accordance with another preferred embodiments of the present invention.

Referring to FIG. 22, another alternative embodiment of the present invention is illustrated. The barrel portion 18 can be formed of a proximal member 36, a distal member 38 and an intermediate member 140 positioned between the proximal and distal members 36 and 38. The intermediate member 140 is a hollow, tubular body having a cylindrical shape. Alternatively, other hollow, tubular shapes can also be used. The intermediate member 140 is preferably formed of strong, durable and resilient material, such as, a composite material. In alternative preferred embodiments, the intermediate member 140 can be formed of an aluminum alloy, a titanium alloy, a scandium alloy, steel, other alloys, a thermoplastic material, a thermoset material, wood or combinations thereof. The intermediate member 140 includes fifth and sixth end regions 142 and 144. The second end region 42 of the proximal member 36 overlaps with the fifth end region 142 to form a third overlap region 146, and the third end region 44 of the distal member 48 overlaps with the sixth end region 144 to form the fourth overlap region 148. The third and fourth overlap regions 146 and 148 can be designed in accordance with any of the configurations of the first overlap region 52 described above. For example, although FIG. 22 illustrates the second and third end regions 42 and 44 extending over the fifth and sixth end regions 142 and 144, respectively, to form the third and fourth overlap regions 146 and 148, the barrel portion 18 can be formed in an opposite configuration with the fifth and sixth end regions 142 and 144 extending over the second and third end regions 42 and 44, respectfully. The intermediate member 140 preferably has a length within the range of 1 inch to 8 inches. Preferably, at least a portion of the intermediate member 140 forms the outer surface of the barrel portion 18. The intermediate member 140 can be sized and positioned such that its mid-length is at or within plus or minus three inches of the COP of the bat.

Figure 23:
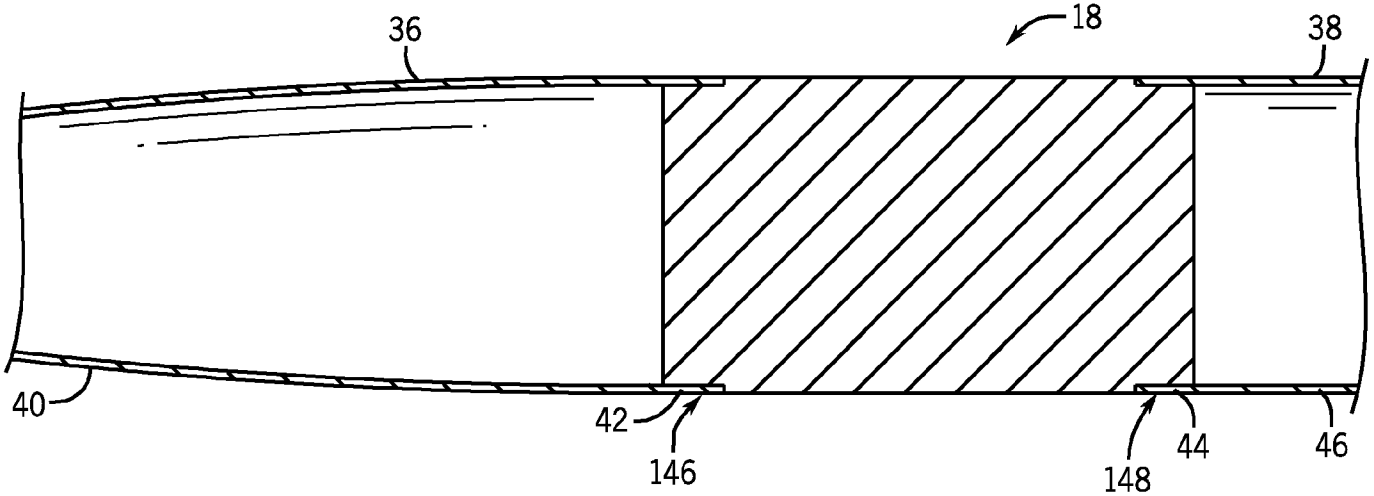

In a preferred embodiment, the barrel portion 18 is a tubular body formed of the proximal, distal and intermediate members 36 and 38 and 140 and is entirely hollow without tie rods and other structure within the tubular body of the barrel portion 18. In alternative preferred embodiments, at least part of one or more of the distal, proximal and intermediate members can be non-hollow or solid. For example, FIG. 23 illustrates the intermediate member 140 formed as a non-hollow or solid member.

Figure 24:
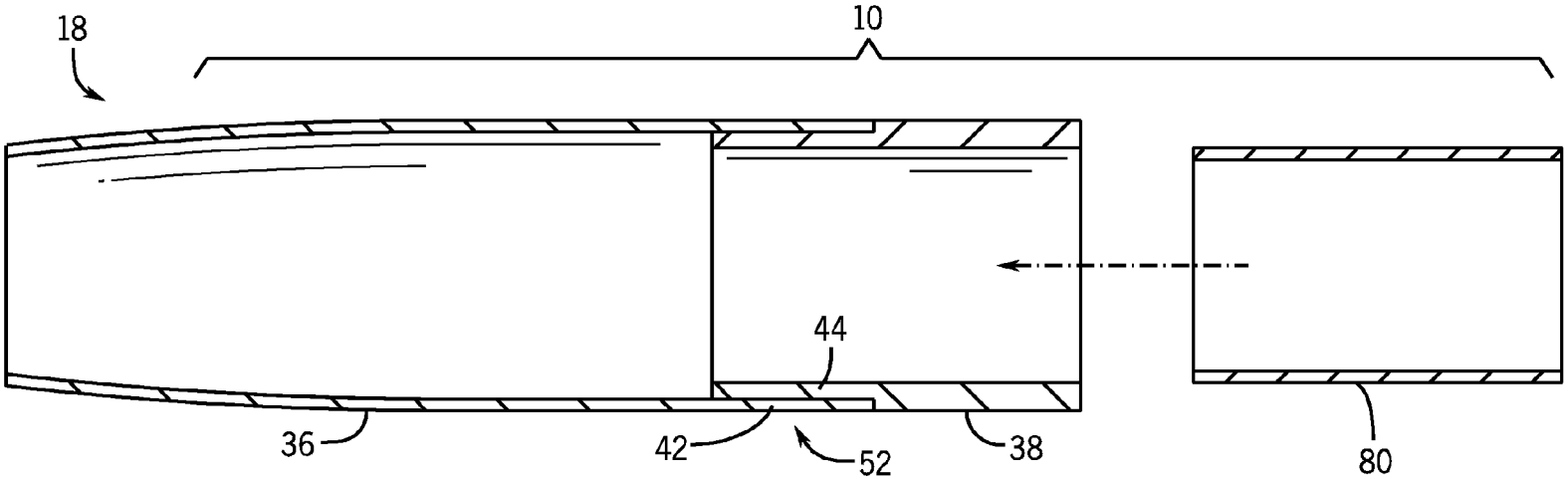
FIG. 24 is an exploded, longitudinal cross-sectional view of the barrel portion of the bat and an insert in accordance with another alternative preferred embodiment of the present invention.

Referring to FIG. 24, in another preferred embodiment of the present invention, an insert 80 can be placed within the barrel portion 18. The insert 80 can vary in length and wall thickness, and it can be positioned in any position within the barrel portion 18. The insert 80 can be used to provide additional strength and/or stiffness to the bat 10. In one particularly preferred embodiment, the insert 80 can be formed and installed within the barrel portion 18 such that independent movement or leaf-spring action can occur between the barrel portion 18 and the insert 80 upon impact with a ball. Such independent movement can enhance the performance of the bat 10. The insert 80 is preferably formed of a strong material, such as an aluminum alloy. Alternatively, other materials can be used such as, a titanium alloy, a scandium alloy, steel, a composite material, a thermoplastic material, a thermoset material, wood and combinations thereof. In other alternative embodiments, the insert can be multiple concentric rings or one or more pieces forming a non-hollow cylindrical insert.

Figure 25:
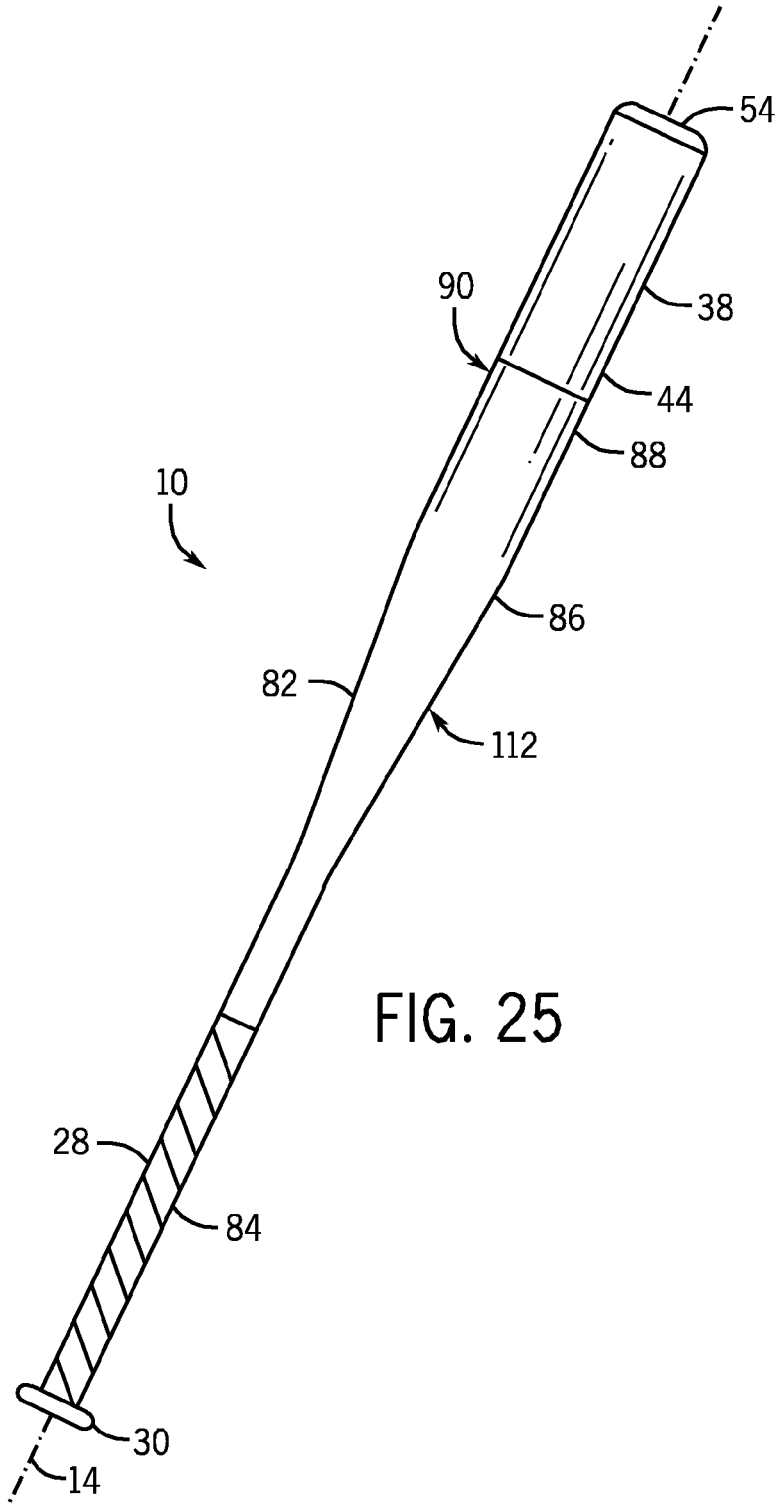
FIG. 25 is a side view of a ball bat in accordance with another preferred embodiment of the present invention.

Referring to FIG. 25, in another alternative preferred embodiment of the present invention, a frame 112 of the bat 10 can be essentially a two-piece bat frame, wherein a first frame piece 82 includes a gripping portion 84 integrally formed to a transition portion 86. The transition portion 86 has a distal end region 88. The second end piece is essentially the same as the distal member 38. The distal end region 88 of the transition portion 86 and the third end region 44 of the distal member 38 overlap each other to form a third overlap region 90. The third overlap region 90 is substantially the same as the first overlap region 52. The first frame piece 82 combines the handle portion 16 and the proximal member 36 of earlier described embodiments into a single frame bat frame piece, the first frame piece 82. Accordingly, the first frame piece 82 is formed as a single integral piece of a strong, flexible and durable material, such as, for example, an aluminum alloy. Alternatively, the first frame piece 82 can be formed of other materials such as, for example, a composite material, a titanium alloy, a scandium alloy, other alloys, steel, and combinations thereof. With the exception of the first frame piece 82 combining the handle portion with the proximal member and eliminating the second overlap region, the bat 10 of the present embodiment (FIG. 25) is substantially the same as the bat 10 of the embodiments described above. The third overlap region 90 can take any of the forms described above with respect to the overlap region 52. The gripping portion 84 of the first frame piece has a first mean outside diameter, and the distal end region of the transition portion 86 has a second mean outside diameter, and wherein the second mean outside diameter is at least 50 percent greater than first mean outside diameter.

The bat 10 of the present invention provides numerous advantages over existing ball bats. One such advantage is that the bat 10 of the present invention is configured for competitive, organized baseball or softball. For example, embodiments of ball bats built in accordance with the present invention can fully meet the bat standards and/or requirements of one or more of the following baseball and softball organizations: Amateur Softball Association of America ("ASA") Bat Testing and Certification Program Requirements (including the current ASA 2004 Bat Standard and the ASA 2000 Bat Standard); United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol. Accordingly, the term "bat configured for organized, competitive play" refers to a bat that fully meets the ball bat standards and/or requirements of, and is fully functional for play in, one or more of the above listed organizations.

Further, bats produced in accordance with the present invention can be configured to fully satisfy the BBCOR Standard while providing players with a bat that is reliable, playable, produces exceptional feel and optimizes performance along the barrel portion or hitting portion of the bat. Bats produced in accordance with the present invention are configured to be durable and reliable and are not prone to failure and shattering during normal use. The present invention significantly improves the flexibility of the bat design further increasing the ability of the bat to be specifically tailored, tuned and designed for a particular player, a particular team, and/or a particular application. The multi-piece barrel portion allows for different materials to be used at different locations of the barrel and to optimize the MOI of the barrel portion and the bat itself. The present invention allows the wall thickness of the materials forming the proximal and distal members to be controlled to define the overlap region, its thickness, its length, and its position allowing for stiffness profiles to be tuned for the bat and the barrel portion and for the bat to be specifically configured for particular purpose, application and/or performance level.

While the preferred embodiments of the invention have been illustrated and described, it will be appreciated that various changes can be made therein without departing from the spirit and scope of the invention. For example, the wall thickness of the barrel portion of the bat can be adjusted or varied to accentuate or fine tune the performance of the bat in association with the annular member. Accordingly, it will be intended to include all such alternatives, modifications and variations set forth within the spirit and scope of the appended claims.

What is claimed is:

1. A ball bat extending along a longitudinal axis, the bat comprising:

a handle portion; and a barrel portion having an outer surface and including a proximal member and a distal member, the proximal member having first and second end regions and the distal member having third and fourth end regions, the first end region being coupled to the handle portion, the second end region of the proximal member being coupled to the third end region of the distal member, and the fourth end region of the distal member coupled to an end cap, at least a portion of each of the proximal and distal members defining at least 30 percent of the outer surface of the barrel portion, the second end region overlapping the third end region to form an overlap region, and the overlap region being the only overlap region within the barrel portion, the single overlap region forming a single inner barrel wall underlying a single outer barrel wall, the single inner barrel wall being not axially segmented from the remaining regions of the barrel portion outside of the single overlap region, the overlap region extending over a minority of the total length of the barrel portion.

2. The ball bat of claim 1 wherein the overlap of the second and third end regions forms a barrel overlap region, and wherein the wall thickness of the barrel overlap region is greater than the wall thickness of either the proximal member or the distal member.

3. The ball bat of claim 1 wherein the length of the overlap of the second and third end regions measured with respect to the longitudinal axis is within the range of 1.0 inches to 2.5 inches.

4. The ball bat of claim 1, wherein the bat has a center of percussion, and wherein the mid-length of the overlap of the second and third end regions is longitudinally positioned within three inches of the center of percussion of the bat.

5. The ball bat of claim 1, wherein, when the bat is tested in accordance with the NCAA Standard for Testing Baseball Bat Performance, the bat has a maximum BBCOR value of less than or equal to 0.500.

6. The ball bat of claim 1, wherein the overlap of the second and third end has a length measured with respect to the longitudinal axis, and wherein the center of the length of the overlap is within the range of 5.0 to 9.0 inches from a distal end of the bat.

7. The ball bat of claim 1, wherein the handle portion is formed of a first material, the proximal member of the barrel portion is formed of a second material, and the distal member is formed of a third material.

8. The ball bat of claim 7, wherein the first, second and third materials are different from each other.

9. The ball bat of claim 1, wherein the overlap of the second and third end regions includes contact between the second and third end regions.

10. The ball bat of claim 1, further comprising a thermoset adhesive coupling the second end region to the third end region.

11. A ball bat extending along a longitudinal axis, the bat comprising:

a handle portion; and a barrel portion having an outer surface and including a single proximal member, a single distal member, without a separate tubular member forming at least part of the outer surface of the barrel portion positioned between the single proximal member and the single distal member, the proximal member having first and second end regions and the distal member having third and fourth end regions, the first end region being connected to the handle portion, the second end region of the proximal member being connected to the third end region of the distal member through an interface that is sufficiently non-elastomeric such that the interface does not substantially reduce the axial stiffness profile of the barrel portion, and the fourth end region of the distal member connected to an end cap, at least a portion of each of the proximal and distal members defining the outer surface of the barrel portion, one of the second and third end regions overlapping the other of the second and third end regions to form an overlap region, the overlap region being the only overlap region within the barrel portion, and the end cap being spaced apart from the proximal member.

12. The ball bat of claim 11 wherein the length of the overlap of the second and third end regions measured with respect to the longitudinal axis is within the range of 0.1 inches to 7 inches.

13. The ball bat of claim 11 wherein the barrel portion has a first length, and wherein the length of the overlap of the second and third end regions measured with respect to the longitudinal axis is within the range 5 percent to 95 percent of the first length.

14. The ball bat of claim 11 wherein the length of the overlap of the second and third end regions measured with respect to the longitudinal axis is within the range of 1.0 inches to 2.5 inches.

15. The ball bat of claim 11, wherein the bat has a center of percussion, and wherein the mid-length of the overlap of the second and third end regions is longitudinally positioned within three inches of the center of percussion of the bat.

16. The ball bat of claim 11, wherein, when the bat is tested in accordance with the NCAA Standard for Testing Baseball Bat Performance, the bat has a maximum BBCOR value of less than or equal to 0.500.

17. The ball bat of claim 11, wherein the overlap of the second and third end regions includes contact between the second and third end regions.

18. The ball bat of claim 11, further comprising a thermoset adhesive connecting the second end region to the third end region.

* * * * *